US010563343B2

(12) United States Patent
Chung et al.

(10) Patent No.: US 10,563,343 B2
(45) Date of Patent: Feb. 18, 2020

(54) DRYER AND METHOD FOR CONTROLLING THE SAME

(71) Applicant: Samsung Electronics Co., Ltd., Suwon-si, Gyeonggi-do (KR)

(72) Inventors: Seung Eun Chung, Yongin-si (KR); Da Eun Kim, Seoul (KR); Jin Han Kim, Suwon-si (KR); Yong Soon Park, Seoul (KR); Sung Chan Yun, Suwon-si (KR); Dong Woo Lee, Yongin-si (KR); Seok-Mo Chang, Incheon (KR); Hee-Soo Jeong, Suwon-si (KR); Jin Young Choi, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 34 days.

(21) Appl. No.: 15/874,564

(22) Filed: Jan. 18, 2018

(65) Prior Publication Data

US 2018/0202097 A1 Jul. 19, 2018

(30) Foreign Application Priority Data

Jan. 18, 2017 (KR) ..... 10-2017-0008546

(51) Int. Cl.
*D06F 58/28* (2006.01)
*D06F 58/02* (2006.01)
*D06F 58/26* (2006.01)

(52) U.S. Cl.
CPC ..... *D06F 58/28* (2013.01); *D06F 58/02* (2013.01); *D06F 58/26* (2013.01);
(Continued)

(58) Field of Classification Search
CPC ..... D06F 58/28; D06F 58/02; D06F 58/26; D06F 2058/2803; D06F 2058/2864; D06F 2058/2877; D06F 2058/289
(Continued)

(56) References Cited

U.S. PATENT DOCUMENTS 2,406,494 A * 8/1946 Ferris ..... D06F 58/02 34/274
4,112,590 A * 9/1978 Muller ..... D06F 25/00 34/596
(Continued)

FOREIGN PATENT DOCUMENTS

EP 1686211 B1 * 3/2014 ..... D06F 58/26
JP 11-319395 A 11/1999
(Continued)

OTHER PUBLICATIONS

International Search Report dated May 23, 2018 in connection with International Patent Application No. PCT/KR2018/000768.
(Continued)

*Primary Examiner* — Stephen M Gravini

(57) ABSTRACT

Provided are a dryer and method for controlling the same, which may appropriately and efficiently dry objects thrown into a receiving space by using high frequency electric fields and heated air. In accordance with one aspect of the present disclosure a dryer includes a main body, a drum rotationally placed inside the main body, a driver provides rotational force to the drum, an electrode part produces an electric field inside the drum, a power supplier supplies power to the electrode part, an air heater heats air, a blower supplies heated air into the drum and a controller controls the power supplier to block power supplied to the electrode part depending on a dried state of an object contained in the
(Continued)

drum, controls the driver to rotate the drum, and controls the air heater and the blower to supply heated air into the drum.

20 Claims, 28 Drawing Sheets

(52) U.S. Cl.
CPC ..... *D06F 2058/2803* (2013.01); *D06F 2058/289* (2013.01); *D06F 2058/2838* (2013.01); *D06F 2058/2877* (2013.01)

(58) Field of Classification Search
USPC ..... 34/492
See application file for complete search history.

(56) References Cited

U.S. PATENT DOCUMENTS 5,435,837 A * 7/1995 Lewis ..... H05F 3/04 34/480
5,555,641 A 9/1996 Lee
6,085,556 A * 7/2000 Moon ..... D06F 35/002 68/13 A
6,564,591 B2 * 5/2003 Noyes ..... D06G 1/005 68/5 C
6,954,995 B2 * 10/2005 Kitamura ..... D06F 25/00 34/597
7,020,986 B1 * 4/2006 Nakai ..... D06F 58/22 34/596
7,392,600 B2 * 7/2008 Gerlach ..... D06F 58/203 34/381
7,421,865 B2 * 9/2008 Lee ..... D06F 25/00 68/15
7,543,396 B2 * 6/2009 Nishino ..... D06F 58/26 34/231
7,571,553 B2 * 8/2009 Joerger ..... D06F 39/005 34/378
7,624,601 B2 * 12/2009 Ikemizu ..... A01N 25/24 68/13 A
7,627,960 B2 * 12/2009 Beyerle ..... D06F 58/04 34/602
7,644,514 B2 * 1/2010 Heyder ..... D06F 58/06 34/218
7,665,227 B2 * 2/2010 Wright ..... D06F 25/00 34/339
7,694,434 B2 * 4/2010 Lee ..... D06F 58/20 34/607
7,735,345 B2 * 6/2010 Wright ..... D06F 35/003 312/228
7,836,607 B2 * 11/2010 Kim ..... D06F 58/04 165/158
7,895,771 B2 * 3/2011 Prajescu ..... D06F 58/20 138/114
7,921,578 B2 * 4/2011 McAllister ..... D06F 35/00 134/10
7,946,057 B2 * 5/2011 Dittmer ..... D06F 58/20 34/597
7,975,400 B2 * 7/2011 Dittmer ..... D06F 58/28 204/560
8,020,231 B2 * 9/2011 Lee ..... D06F 35/008 68/12.02
8,042,282 B2 * 10/2011 Oh ..... D06F 58/04 126/299 D
8,286,369 B2 * 10/2012 Dittmer ..... D06F 58/28 204/560
8,468,711 B2 * 6/2013 Kim ..... D06F 58/22 134/12
8,516,716 B2 * 8/2013 Dal Ben ..... D06F 58/04 34/601
8,516,860 B2 * 8/2013 Persson ..... D06F 25/00 68/19
8,695,228 B2 * 4/2014 Lee ..... D06F 73/02 34/595
8,844,160 B2 * 9/2014 Beihoff ..... D06F 58/203 34/409
8,948,922 B2 * 2/2015 Schleuthner ..... D06F 33/02 34/527
9,175,434 B1 * 11/2015 Brown ..... D06F 58/02
9,212,446 B2 * 12/2015 Park ..... D06F 35/005
9,255,358 B2 * 2/2016 Kim ..... D06F 58/24
9,335,095 B2 * 5/2016 Bison ..... D06F 39/12
9,758,921 B2 * 9/2017 Bison ..... D06F 58/28
10,266,984 B1 * 4/2019 Brown ..... D06F 58/02
2005/0091878 A1 * 5/2005 Yang ..... D06F 58/26 34/549
2007/0209228 A1 * 9/2007 Meerpohl ..... D06F 58/28 34/595
2014/0245630 A1 * 9/2014 McCarthy ..... D06F 58/04 34/487
2014/0325865 A1 * 11/2014 Wisherd ..... D06F 58/266 34/255
2015/0089829 A1 4/2015 Herman et al.
2015/0096191 A1 4/2015 Jung et al.
2015/0337481 A1 * 11/2015 Bae ..... D06F 39/005 34/245
2016/0130743 A1 * 5/2016 Wisherd ..... D06F 58/266 34/261
2016/0326688 A1 11/2016 Choi et al.
2018/0202097 A1 * 7/2018 Chung ..... D06F 58/28

FOREIGN PATENT DOCUMENTS

JP 5675406 B2 2/2015
KR 1994-0018519 A 8/1994
KR 1998-083651 A 12/1998
KR 2002-0045881 A 6/2002
KR 10-0461637 B1 12/2004
KR 10-2006-0120883 A 11/2006
KR 10-1178242 B1 8/2012
WO WO-03035962 A1 * 5/2003 ..... D06F 58/26
WO 2004111327 A1 12/2004
WO WO-2018135845 A1 * 7/2018 ..... D06F 58/28

OTHER PUBLICATIONS

European Patent Office, "Invitation pursuant to Rule 62a(1) EPC," Application No. EP18742039.3, Sep. 2, 2019, 2 pages.
European Patent Office, "Supplementary Partial European Search Report," Application No. EP18742039.3, Dec. 12, 2019, 9 pages.

* cited by examiner

DRYER AND METHOD FOR CONTROLLING THE SAME

CROSS-REFERENCE TO RELATED APPLICATION AND CLAIM OF PRIORITY

This application claims priority to and the benefit of Korean Patent Application No. 10-2017-0008546, filed on Jan. 18, 2017, the disclosure of which is incorporated herein by reference in its entirety.

TECHNICAL FIELD

The present disclosure relates to a dryer and method for controlling the same.

BACKGROUND

In general, dryers are devices for drying various objects such as clothes by rotating a drum containing the objects at low speed and forcing hot air to pass the inside of the drum.

The hot air dryers dry objects with hot air produced by heating air flowing into the drum and making the hot air contact the objects to vaporize water.

The hot air dryer may include the drum rotationally installed therein for containing the objects, a driver for driving the drum, a supply path for guiding inflow of air to the drum, a heater for heating the air flowing in through the supply path, a blower for blowing the heated air into the rotating drum, and a discharge path for guiding the air to be discharged out of the drum.

SUMMARY

To address the above-discussed deficiencies, it is a primary object to provide a dryer and method for controlling the same, which may appropriately and efficiently dry objects thrown into a receiving space by using high frequency electric fields and heated air.

In accordance with one aspect of the present disclosure a dryer comprise a main body, a drum rotationally placed inside the main body, a driver configured to provide rotational force to the drum, an electrode part configured to produce an electric field inside the drum, a power supplier configured to supply power to the electrode part, an air heater configured to heat air, a blower configured to supply heated air into the drum and a controller configured to control the power supplier to block power supplied to the electrode part depending on a dried state of an object contained in the drum, control the driver to rotate the drum, and control the air heater and the blower to supply heated air into the drum.

The controller may control the driver to rotate the drum at the same time as or after the power supplied to the electrode part is blocked.

The controller may control the air heater and the blower to supply heated air into the drum at the same time as or after the drum starts rotating.

The controller is configured to drop an output of the power supplier if a voltage applied to the electrode part exceeds a reference voltage.

The dryer may further comprise a first air inlet formed around the electrode part and a second air inlet formed in a direction of the rear side of a container.

The dryer may further comprise an air inflow path through which air flows in, a first air supply path connected to the first air inlet, a second air supply path connected to the second air inlet and a flow path open/shut part configured to connect one of the first and second air supply paths to the air inflow path.

The flow path open/shut part may connect the first air supply path to the air inflow path if the power supplier is operating, and to connect the second air supply path to the air inflow path if the power supplier is not operating.

The air heater may be installed in the second air supply path.

In accordance with another aspect of the present disclosure, a dryer comprise a cylindrical drum rotationally placed inside a main body and equipped with an inlet on the front of the rotary drum, an electrode part configured to produce an electric field in a perpendicular direction to a rotation center of the drum, a first air inlet formed on a cylindrical wall of the drum and a second air inlet formed on the back of the drum, wherein if the drum is not rotating, air is supplied into the drum through the first air inlet, and if the drum is rotating, air is supplied into the drum through the second air inlet.

The dryer may further comprise an air heater configured to heat the air supplied into the drum through the second air inlet.

The air supplied into the drum may be discharged out of the drum through a discharge port.

In accordance with other aspect of the present disclosure, a method for controlling a dryer having a rotary drum, the method comprise producing an electric field by an electrode part installed inside the drum, determining whether to operate a power supplier to supply power to the electrode part depending on a dried state of an object contained in the drum, blocking power supplied to the electrode part according to the determination of operation of the power supplier and starting rotation of the drum and supplying heater air into the drum.

The starting rotation of the drum and supplying heater air into the drum may comprise rotating the drum at the same time as the power supplied to the electrode part is blocked or rotating the drum after the power supplied to the electrode part is blocked.

The starting rotation of the drum and supplying heater air into the drum may comprises supplying heated air into the drum at the same time as the start of rotation of the drum or supplying heated air into the drum after the start of rotation of the drum.

The method may further comprise dropping an output of the power supplier if a voltage applied to the electrode part exceeds a reference voltage.

The method may further comprise allowing air to flow into the drum through a first air inlet formed around the electrode part if the power supplier operates and produces an electric field in receiving space of a container of the dryer.

The starting rotation of the drum and supplying heater air into the drum may comprise supplying the heated air into the drum through a second air inlet formed in the direction of the back of the drum.

The method may further comprise discharging the heated air supplied into the drum to the outside of the drum through a discharge port.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
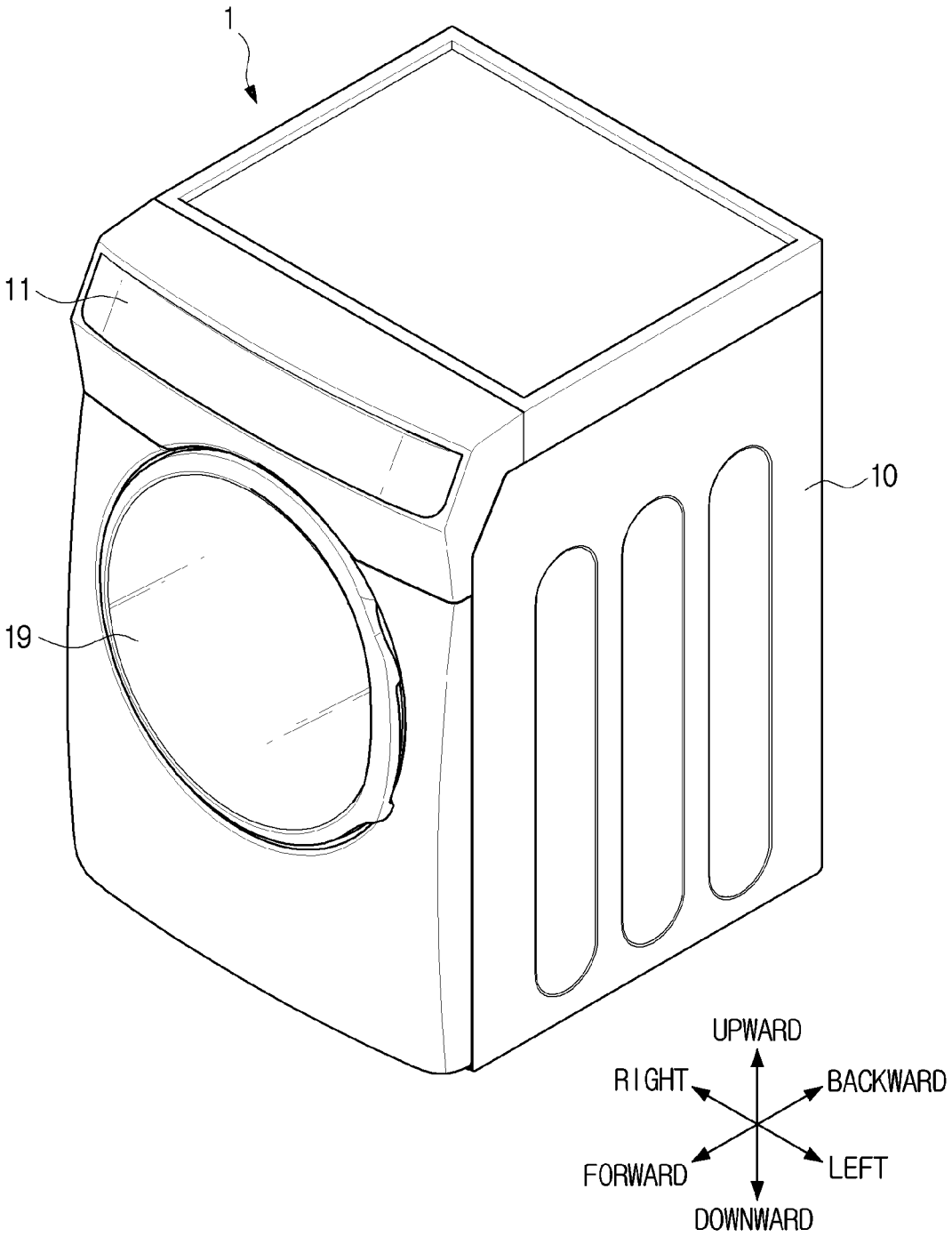
FIG. 1 shows the exterior of a dryer, according to an embodiment of the present disclosure.

FIGS. 1 through 28, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Throughout the specification, like reference numerals refer to like elements unless stated otherwise. The term 'unit' as herein used may be implemented in software or hardware, and may be implemented in a part or in multiple parts.

Throughout the specification, if a portion is connected to another, it means physical connection or electrical connection made between them.

Furthermore, the term "include (or including)" or "comprise (or comprising)" is inclusive or open-ended and does not exclude additional, unrecited elements or method steps, unless otherwise mentioned.

Ordinal terms like 'first', 'second', etc., are used to distinguish a part from another, and do not mean that they are arranged or performed sequentially unless otherwise mentioned.

It is to be understood that the singular forms "a," "an," and "the" include plural forms unless there is a clear exception in the context.

Various embodiments of a dryer will now be described with reference to FIGS. 1 to 17.

Figure 2:
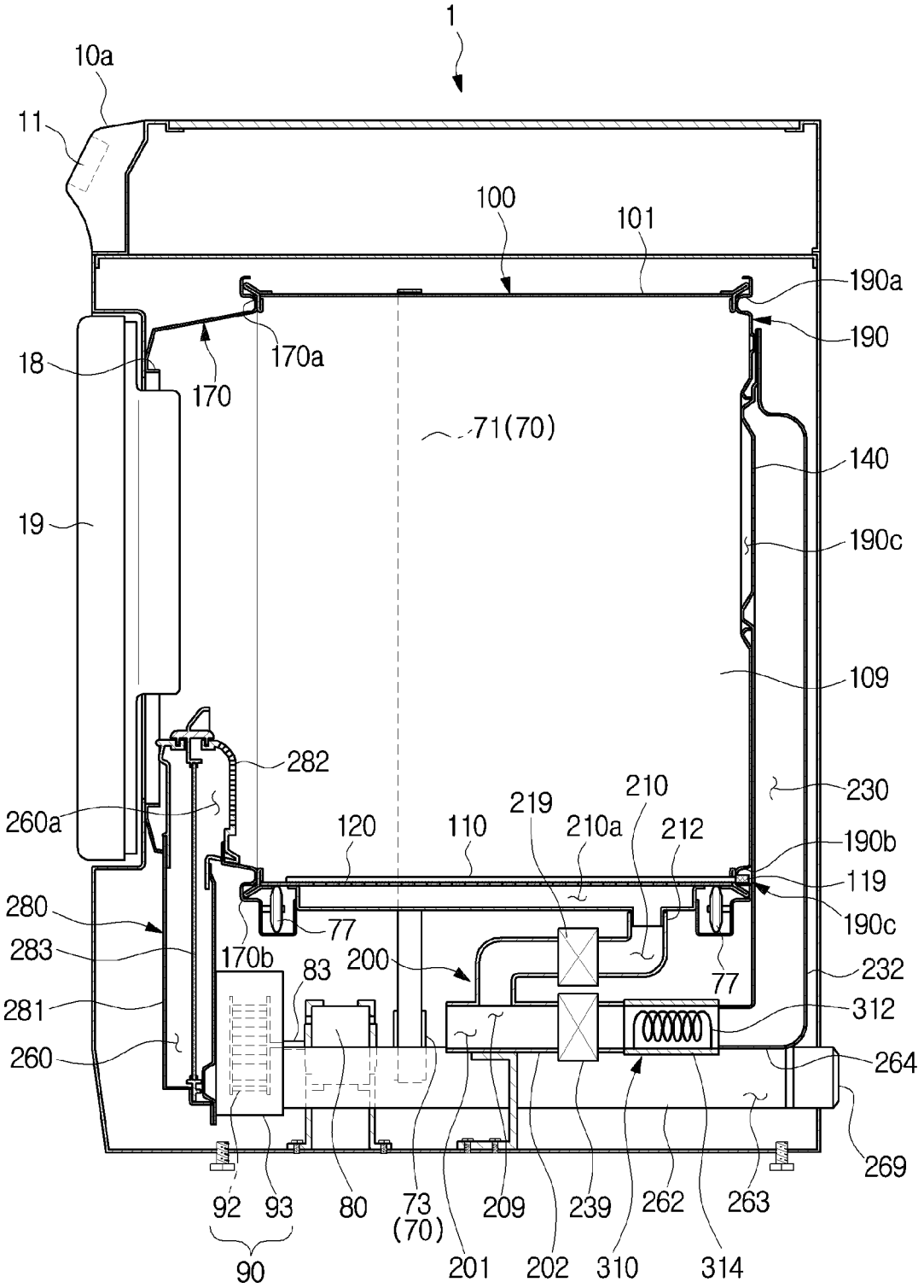
FIG. 2 is a side cross-sectional view of a dryer, according to an embodiment of the present disclosure.

FIG. 1 shows the exterior of a dryer, according to an embodiment of the present disclosure, and FIG. 2 is a side cross-sectional view of a dryer, according to an embodiment of the present disclosure.

A direction in which a door 19 is installed is defined as a forward direction and the opposite direction of the forward direction is defined as a backward direction. A direction of the ground on which the dryer 1 is installed is defined as a downward direction and the opposite direction of the downward direction is defined as an upward direction. Furthermore, a direction perpendicular to the line connecting the upward and downward directions and the line connecting the forward and backward direction is defined as a left direction, and the opposite direction of the left direction is defined as a right direction. However, such definitions are just for convenience of explanation, and may vary according to the designer's arbitrary selection.

Referring to FIGS. 1 and 2, in an embodiment, the dryer 1 may include a main body 10 having a container 100 therein, a user interface 11 and the door 19 installed on the outer face of the main body 10.

The main body 10 may include an exterior frame 10*a* of a certain shape, inside which various parts required for operation of the dryer 1 as well as the container 100 are contained. The shape of the exterior frame 10*a* may be e.g., almost a hexahedron. On the front of the exterior frame 10*a*, there may be an inlet 18.

The user interface 11 may receive various commands related to operation of the dryer 1 from the user or provide various kinds of information about operation or state of the dryer 1 to the user.

The user interface 11 may include an input 11*a* (see FIG. 14) through which various commands are received, and an output 11*b* (see FIG. 14) through which various information is output visually or audibly. The input 11*a* may be implemented using physical buttons, a knob, a track ball, a touch screen, a touch pad, a pressure-sensitive pad, a joy stick, etc. The output 11*b* may be implemented using a display device or a sound output device, the display device being implemented using a lighting device, such as at least one type of display panel or light emitting diodes (LEDs) and the sound output device being implemented using e.g., a speaker.

The door 19 is installed at the inlet 18 formed on the front of the exterior frame 10*a* to open or shut the inlet 18. A receiving space 109 inside the container 100 may or may not be exposed by opening or shutting the door 19. The user may open the door 19 and throw an object 9 to be dried (hereinafter, briefly referred to as an object) into the receiving space 109 through the inlet 18.

The object 9 includes a wet item containing moisture above a certain amount. The item may include various subjects that may be dried by the dryer 1, such as clothes or clothing, bedclothes, blanket, carpet and/or rug.

In an embodiment, the dryer 1 may be configured to perform drying operation while the door 19 is shut, in which case, a sensor (not shown) for detecting whether the door 19 is open or shut may be mounted on the door 19 and/or around the inlet 18. The user may throw the object 9 into the receiving space 109 and shut the door 19, and the dryer 1 may safely perform drying operation.

Referring to FIG. 2, the dryer 1 may include the container 100 provided to be rotatable, an electric field maker 110 for producing an electric field in the receiving space 109 of the container 100, a front frame 170 mounted on the front of the container 100, a rear frame 190 mounted on the back of the container 100, an air supply path 200 for providing a flow path for air flowing into the receiving space 109 of the container 100, a first discharge path 260 for providing a flow path for air discharged from the receiving space 109 of the container 100, and an air heater 310 for heating the entire or part of the air flowing into the container 100.

Figure 3:
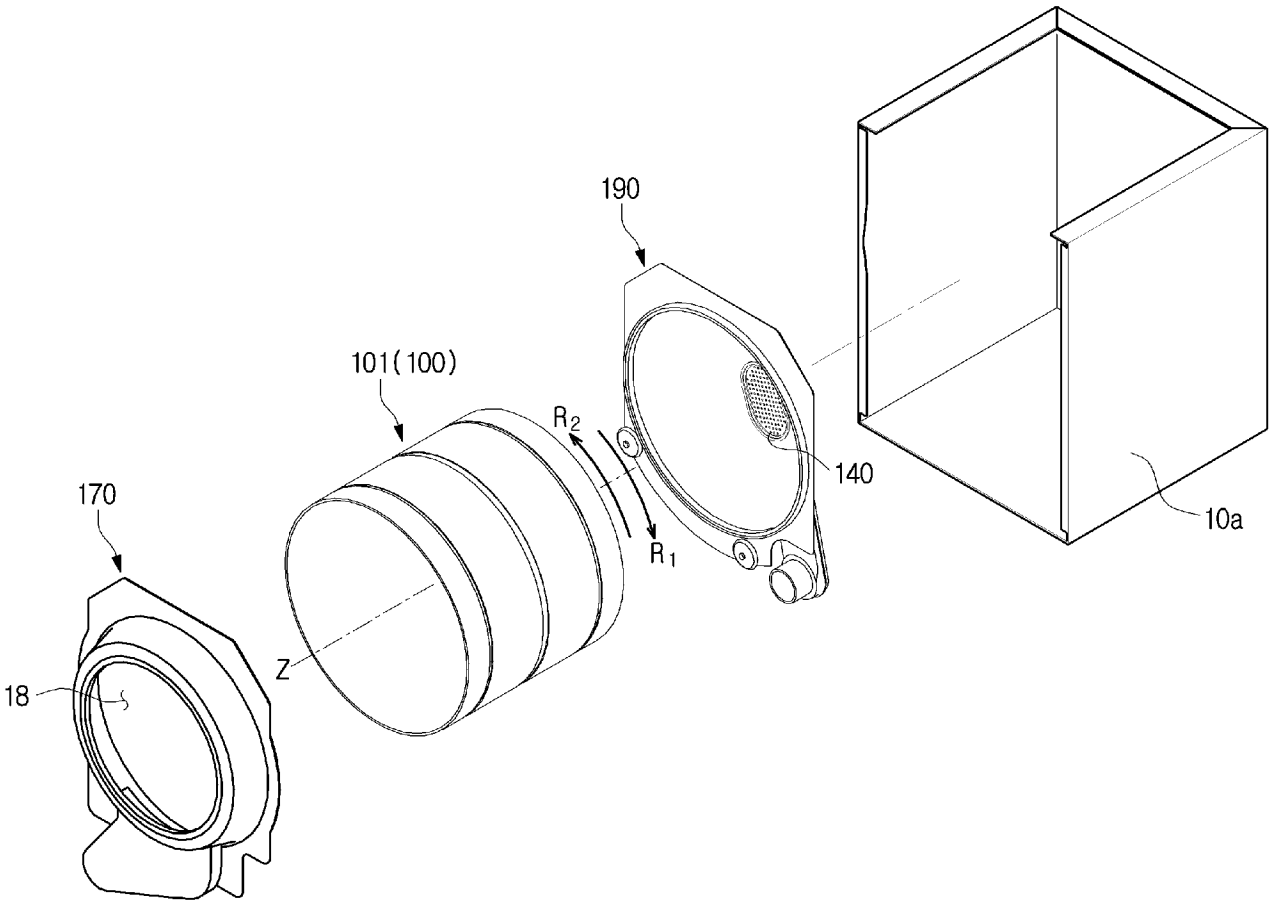
FIG. 3 is a view for explaining a container, a front frame, and a rear frame, according to an embodiment of the present disclosure.

FIG. 3 is a view for explaining a container, a front frame, and a rear frame, according to an embodiment of the present disclosure.

As shown in FIG. 3, the front frame 170, the container 100, and the rear frame 190 may be sequentially arranged from front to back and installed inside the exterior frame 10*a* of the main body 10.

In an embodiment, the container 100 may be implemented using a rotary drum 101.

The rotary drum 101 may have almost a cylindrical form. The rotary drum 101 may be provided with the front and rear sides open. The rotary drum 101 has an opening on the front, which serves as an inlet through which an object to be contained in the rotary drum 101 is thrown in.

The rotary drum 101 may be provided to rotate around an axis z. Specifically, the rotary drum 101 may be configured to rotate around the axis z in at least one direction R1, R2 under the control of a processor 500 (see FIG. 14) separately equipped inside or outside the dryer 1.

The outer circumferential face of the rotary drum 101 faces the inside of the exterior frame 10*a*. The outer circumferential face of the rotary drum 101 is formed for a first air supply duct 212 forming a first air supply path 210 to be connected thereto or disconnected therefrom as necessary.

The container 100 may be arranged between the front frame 170 and the rear frame 190. In this case, the front border of the container 100 may be mounted on the front frame 170 and a rear border of the container 100 may be mounted on the rear frame 190.

The front frame 170 may be arranged to support the container 100 from the front, and may have e.g., a cylindrical form with openings formed on the front and back to correspond to the rotary drum 101. The openings formed on the front and back of the front frame 170 constitute the inlet 18 through which to throw in an object.

The front frame 170 may include front supporters 170*a*, 170*b* to support the front end of the rotary drum 101 and guide rotation of the rotary drum 101. The front supporters 170*a*, 170*b* may be formed along the edge of the front frame 170. For example, the front supporters 170*a*, 170*b* may include protrusions in the form of a ring continuously formed along the edge of the front frame 170. The front supporters 170*a*, 170*b* guide the rotation of the rotary drum 101 while supporting the rotary drum 101 from above, below, and sides.

In an embodiment, a first discharge port 260*a* connected to one end of a first discharge path 260 may be provided in a portion of the front frame 170. In this case, the first discharge port 260*a* formed at the one end of the first discharge path 260 may be formed by extending from a lower region of the front frame 170. Air inside the rotary drum 101 may be discharged out of the rotary drum 101 through the first discharge port 260*a*. If required, a grill 282 may be further installed in the lower region of the front frame 170 where the first discharge port 260*a* is formed.

The rear frame 190 is arranged to support the container 100 from the back. For example, the rear frame 190 may be arranged in a recessed region 190*c* on the inside, and the recessed region 190*c* may have almost a cylindrical form corresponding to the form of the rotary drum 101.

The rear frame 190 may include rear supporters 190*a*, 190*b* formed to support the rear end of the rotary drum 101 and guide rotation of the rotary drum 101.

The rear supporters 190*a*, 190*b* may be formed along the edge of the rear frame 190, and may include, for example, protrusions continuously formed along the edge of the rear frame 190. The protrusion of the rear supporters 190*a*, 190*b* may have the form of a ring. Like the front supporters 170*a*, 170*b*, the rear supporters 190*a*, 190*b* guide the rotation of the rotary drum 101 while supporting the rotary drum 101 from above, below, and sides. The front supporters 170*a*, 170*b* and the rear supporters 190*a*, 190*b* prevent the rotary drum 101 from being displaced from its original position even while being rotated.

Referring to FIG. 2, the rear supporter 190*b* installed underneath the rear frame 190 may have a contact terminal install part 190*c* in which a contact terminal 119 may be installed. The contact terminal install part 190*c* may be provided for the contact terminal 119 to be safely mounted therein, and may be implemented using e.g., a groove into which the contact terminal 119 is inserted and fixed or a fixing protrusion to which the contact terminal 119 is fixed. In addition, the contact terminal install part 190*c* may be implemented in various forms that may be considered by the designer.

In an embodiment, the rear frame 190 may further include at least one second air inlet 140. The at least one second air inlet 140 may be connected to a second air supply path 230 in order for air flowing through the second air supply path 230 to be delivered to the inner space 109 of the rotary drum 101 through the second air inlet 140. It is possible to omit the at least one second air inlet 140.

Furthermore, in some embodiments, the rear frame 190 may further include at least one second discharge port 145 for the air in the receiving space 109 to be discharged out of the rotary drum 101. The second discharge port 145 may be installed in an upper portion or a lower portion of a side of the rear frame 190. It is possible to omit the at least one second discharge port 145.

In some embodiments, the rear frame 190 may include both or one of the at least one second air inlet 140 and the at least one second discharge port 145.

Figure 4:
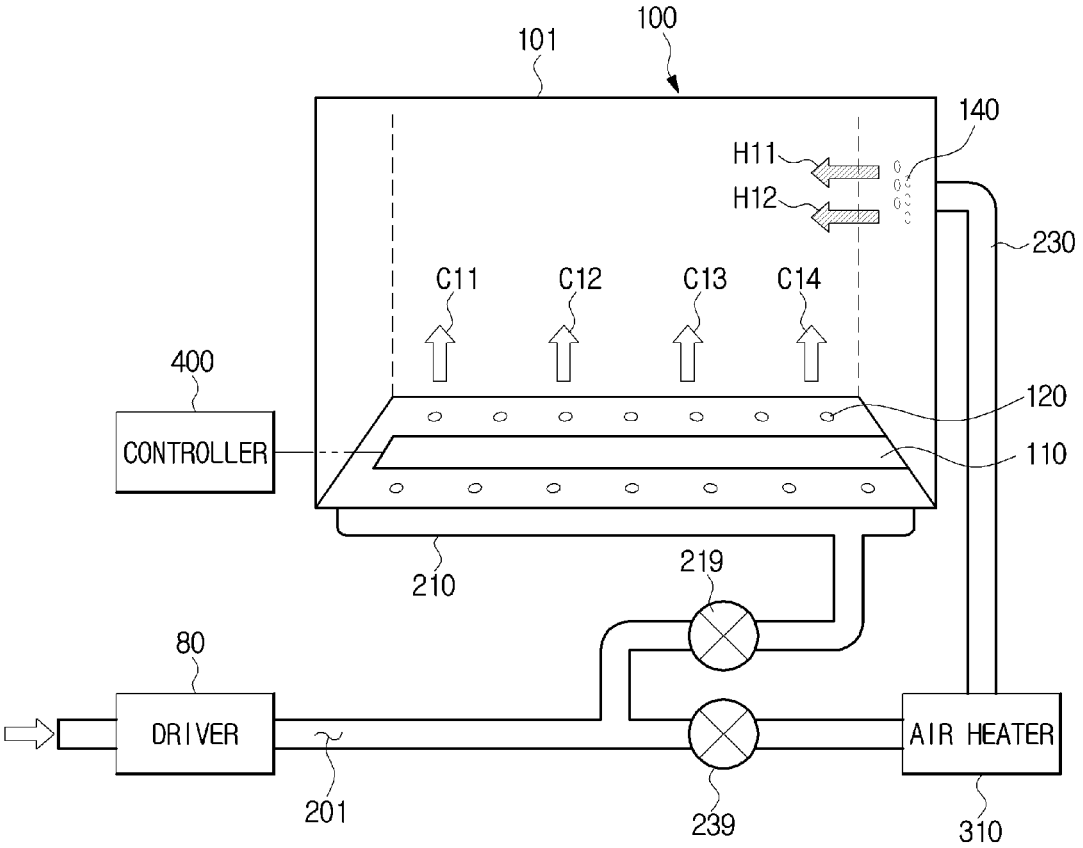
FIG. 4 shows an embodiment of a container and an air supply path connected to the container.

FIG. 4 shows an embodiment of a container and an air supply path connected to the container.

Referring to FIGS. 2 and 4, the rotary drum 101 may have an electrode part 110 formed therein.

The electrode part 110 produces a certain intensity of electric field in the entire area or in a partial area of the receiving space 109 of the rotary drum 101. The electric field produced by the electrode part 110 may include a high frequency electric field. A frequency range of the high frequency electric field may be defined by the designer in different methods. For example, the frequency range may be a fraction of a few MHz to several GHz range.

In an embodiment, the electrode part 110 may be implemented using a predetermined conductive plate, and the predetermined conductive plate may include, for example, a predetermined metal plate. In this case, the metal plate may be made of zinc, aluminum, magnesium or an alloy thereof. Further, the predetermined conductive plate may be implemented using a ceramic material or the like through which electric current may flow.

The electrode part 110 may function as an anode depending on the voltage/current provided by a power supplier 401. When the electrode part 110 is the anode, the rotary drum 101 may serve as a cathode.

Accordingly, when a voltage/current is applied to the electrode part 110, an electric field E is produced inside the receiving space 109. In this case, the electric field E may be produced in e.g., a perpendicular direction to the rotation axis of the rotary drum 101.

When the high frequency electric field E is produced, the constituent molecules such as ions and dipoles inside the dielectric exposed to the high frequency electric field E vibrate, and heat is created due to the vibration of the constituent molecules. Since the water typically has high permittivity, the moisture contained in the object 9 exposed to the high frequency electric field E is relatively quickly heated and evaporated.

Accordingly, the moisture of the object 9 may be removed.

One end of the electrode part 110 may be formed at a rear end of the rotary drum 101, or in some embodiments, may extend beyond the rear end of the rotary drum 101 to be exposed to the outside of the rotary drum 101. In the latter case, one end of the electrode part 110 may be provided such that it may be connected to or separated from the contact terminal 119 installed at the rear supporter 190*b* as the rotary drum 101 rotates. Accordingly, this may enable or disable the current/voltage to be applied to the electrode part 110.

Referring to FIGS. 2 and 4, the rotary drum 101 constituting the container 100 may further have a first air inlet or air inlets 120 formed therein.

The first air inlet 120 may be formed around the electrode part 110. The air flowing along the first air supply path 210 is discharged into the inner space 109 of the rotary drum 101 through the first air inlet 120.

In an embodiment, the first air inlet 120 may include a plurality of first air inlets.

The plurality of first air inlets may be distributed on the rotary drum 101 randomly or in a predetermined pattern around the electrode part 110. For example, the plurality of first air inlets may be arranged in at least one row along the longitudinal direction of the electrode part 110. The arrangement of the plurality of inlets is not limited thereto. The plurality of inlets may be formed around the electrode part 110 in at least one of patterns that may be arranged according to the designer's selection.

Referring to FIGS. 2 and 4, the air supply path 200 may be installed inside the exterior housing 10*a*. For example, the air supply path 200 may be arranged underneath the container 100. In some embodiments, however, the air supply path 200 may be arranged on one side or on the top of the container 100.

In an embodiment, the air supply path 200 may be implemented using an air inflow duct 202 forming an air inflow path 201, a first air supply duct 212 branching off from a region 209 of the air inflow duct 202 to form the first air supply path 210, and a second air supply duct 232 branching off from the region 209 of the air inflow duct 202 to form the second air supply path 230.

The air inflow duct 202 may be installed in the receiving space of the exterior housing 10*a* and may have an opening formed at one end through which the air in the receiving space of the exterior housing 10*a* may flow in. The air in the receiving space of the exterior housing 10*a* may have been supplied by a discharge duct 292 or may have flown in from the outside through an inlet (not shown) formed on the outer face of the exterior housing 10*a*.

When a driver 80 operates to start rotating operation of a blower fan 92 of a blower 90, the air inside the exterior housing 10*a* is moved toward the air inflow duct 202 and delivered to the air inflow path 201 through the opening of the air inflow duct 202.

The first air supply duct 212 extends towards the bottom of the container 100 for the air flowing into the air inflow duct 202 to be delivered to the first air inlet 120 underneath the container 100 along the first air supply path 210.

One end of the first air supply duct 212 may be connected to the region 209 of the air inflow duct 202 and the other end 210*a* may be placed on the bottom of the container 100. At the other end 210*a*, an opening (not shown) may be formed to correspond to the first air inlet 120.

In an embodiment, the opening at the other end 210*a* may be formed in a corresponding size to a region where the plurality of first air inlets are arranged, allowing inflow of air to all of the first air inlets. If the electrode part 110 is formed along the longitudinal direction of the container 100 and the first air inlet 120 is formed on the side of the electrode part 110 along the electrode part 110, the other end 210*a* of the air supply duct 212 may expand by extending in the longitudinal direction of the container 100 along the arrangement of the first air inlet 120.

A flow path open/shut part, e.g., a first valve 219 to block or open the first air supply path 210 may be installed in the first air supply duct 212. The first valve 219 may be controlled by a controller 400 to be opened or shut, enabling or disabling the air flowing in through the opening of the air inflow duct 202 to flow into the first air supply path 210.

Figure 5:
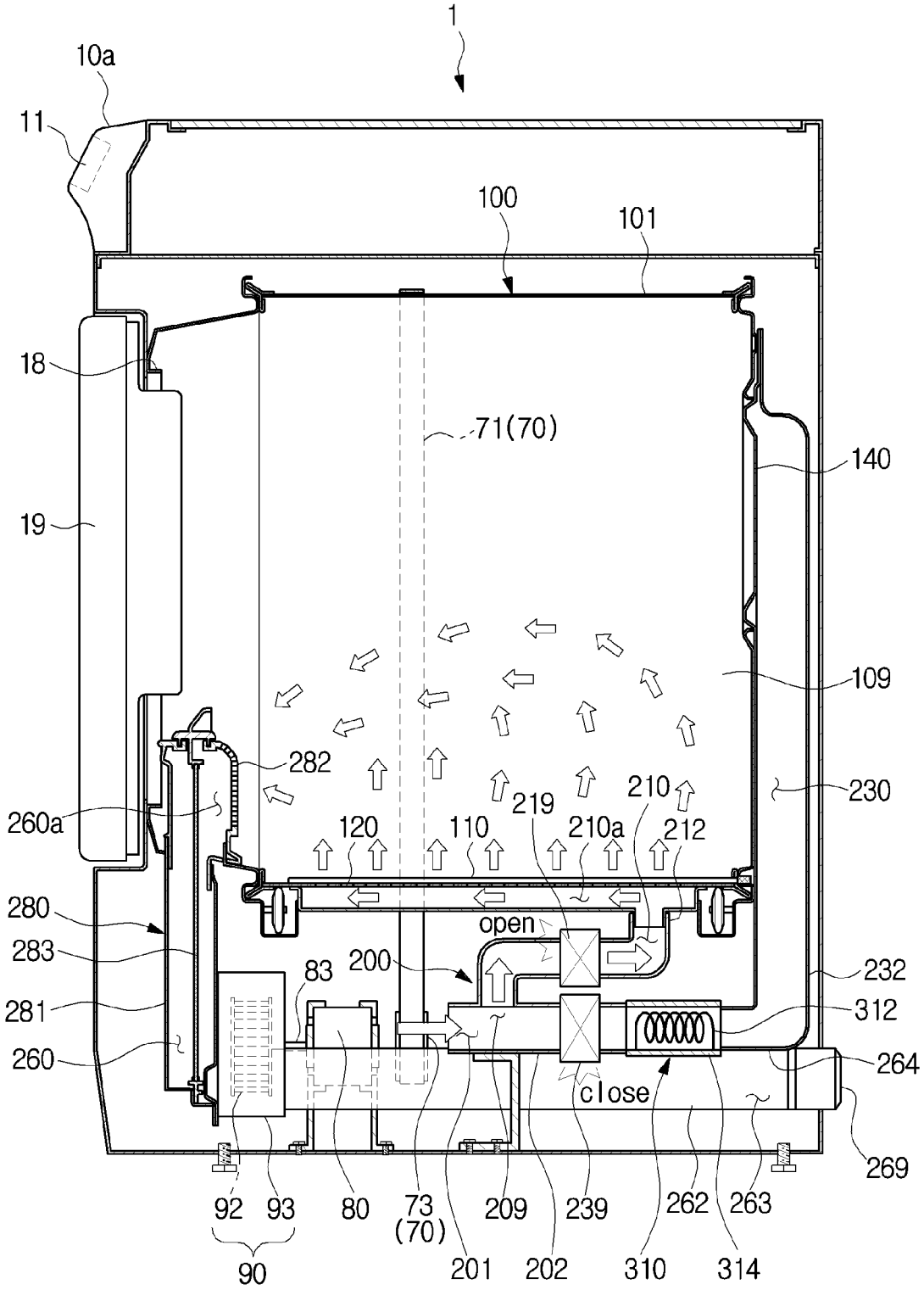
FIG. 5 shows an example of airflow in a case that a first air supply path is opened.

Accordingly, when the first valve 219 is opened, as shown in FIGS. 4 and 5, the air delivered to the air inflow path 201 according to operation of the driver 80 is delivered to the first air inlet 120 along the first air supply path 210 and then moved to the receiving space 109 of the container 100 through the first air inlet 120.

Figure 6:
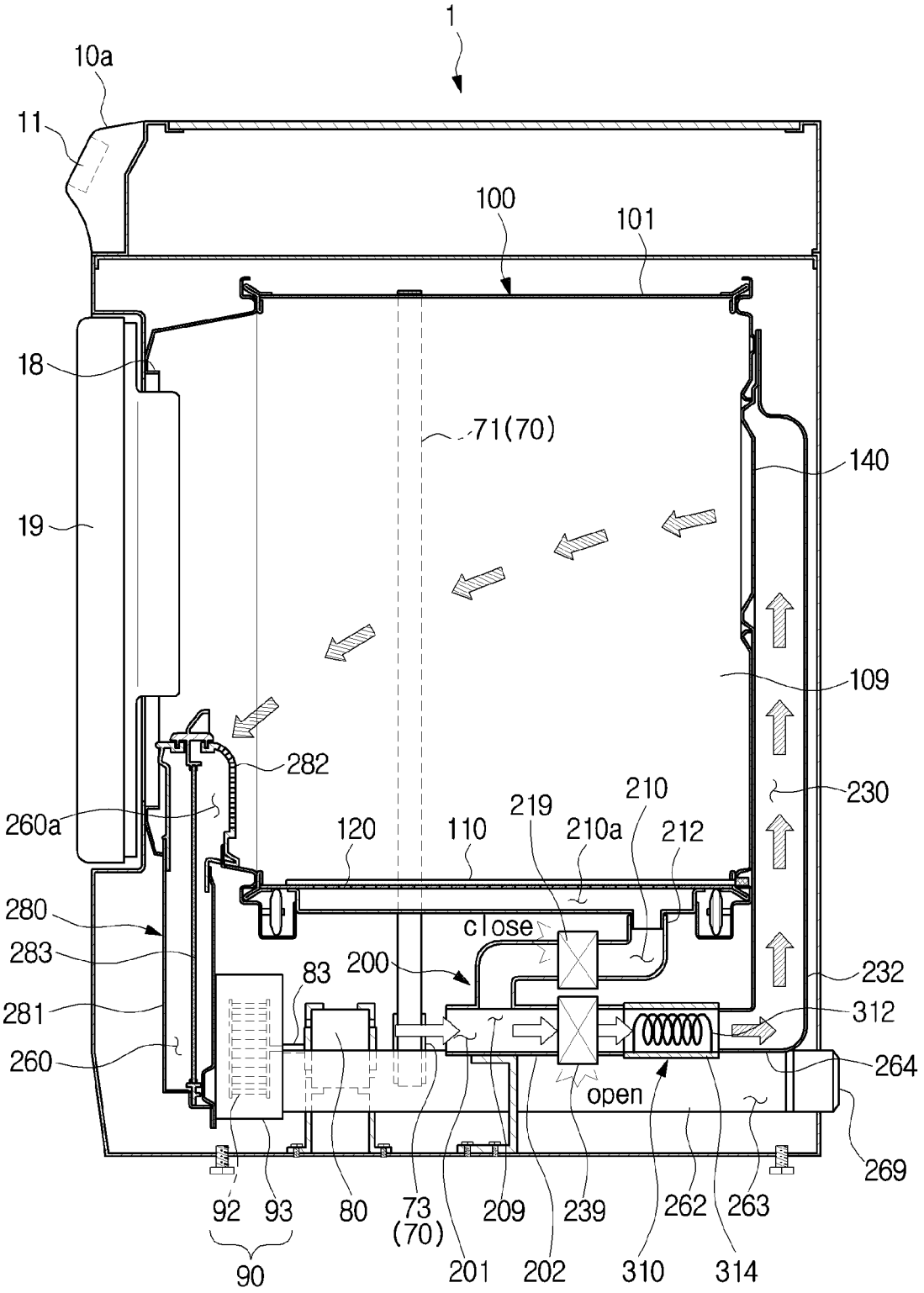
FIG. 6 shows an example of airflow in a case that a second air supply path is opened.

FIG. 5 shows an example of airflow in a case that a first air supply path is opened. FIG. 6 shows an example of airflow in a case that a second air supply path is opened.

As shown in FIGS. 4 and 5, the first air supply path 210 may not have the air heater 310 installed therein. Accordingly, air c11 to c14 discharged from the first air inlet 120 may be non-heated air. The non-heated air c11 to c14 is discharged from around the electrode part 110.

The moisture of the object 9 evaporated by an electric field produced by the electrode part 110 is separated from the object 9 by the air discharged from the first air inlet 120 and moved to the first discharge path 260 along the flow of air supplied into the receiving space 109. Accordingly, the moisture evaporated from the object 9 may be removed from around the object 9 and from the receiving space 109.

In other words, the non-heated air discharged from the first air inlet 120 may be moved toward the first discharge port 260*a* with the operation of the blower fan 92 while carrying the moisture separated from the object 9 by the electric field.

The air c11 to c14 containing the moisture is discharged out of the rotary drum 101 through the opening (i.e., the inlet) of the rotary drum 101 and flows into the first discharge path 260.

The air c11 to c14 flowing into the first discharge path 260 may be delivered back to the receiving space of the exterior housing 10*a*.

The second air supply duct 232 extends in the rear direction of the container 100 so that the air flowing into the air inflow duct 202 along the second air supply path 230 may be delivered to the second air inlet 140 arranged in the back of the container 100.

Specifically, one end of the second air supply duct 232 may be connected to the region 209 of the air inflow duct 202, and the other end and its perimeter may be formed in the rear frame 190. A discharge port (not shown) may be formed at the other end of the second air supply duct 232 to discharge the air that has passed through the second air supply path 230.

In an embodiment, a plurality of second air inlets 140 may be formed in the rear frame 190, in which case the discharge port may be formed to include all the areas where the plurality of second air inlets 140 are arranged to allow air to flow into all of the plurality of air inlets 140.

A flow path open/shut part, e.g., a second valve 239 to block or open the second air supply path 230 may be installed in the second air supply duct 232. The second valve 239 may be controlled by the controller 400 to be opened or shut, thus enabling or disabling the air flowing in through the opening of the air inflow duct 202 to flow to the second air supply path 230.

Accordingly, when the second valve 239 is opened, as shown in FIGS. 4 and 6, the air delivered to the air inflow path 201 with the operation of the driver 80 may be delivered to the second air inlet 140 along the second air supply path 230 and then moved to the receiving space 109 of the container 100 through the second air inlet 140.

In an embodiment, the air heater 310 may further be included in the second air supply duct 232 to heat the air delivered to the second air supply path 230.

The air heater 310 may include, for example, as shown in FIG. 2, a heating coil 312 and an air heater duct 314. The heating coil 312 is heated according to a voltage/current applied from an external source, delivering heat energy to the air moving around the coil 312. The heating coil 312 may deliver electric energy corresponding to the magnitude of the applied voltage/current to the air. In this case, a proper magnitude of voltage/current may be applied to the heating coil 312 to raise the temperature of the air to such an extent that the object 9 may be sufficiently dried.

As shown in FIGS. 4 and 6, the air H11, H12 heated by the heating coil 312 is delivered to the second air supply path 230, passes the second air inlet 140 arranged in the rear frame 190, and is then delivered to the receiving space 109 of the container 100.

The heated air H11 and H12 evaporates the moisture remaining in the object 9 and moves the evaporated moisture. The heated air H11 and H12 is moved toward the first discharge port 260*a* along with the moisture by operation of the blower fan 92.

The air H11 to H12 flowing into the rotary drum 101 may be discharged out of the rotary drum 101 through the opening (i.e., the inlet) of the rotary drum 101.

The air H11 to H12 discharged through the opening may flow into the first discharge path 260 and may be delivered to the receiving space of the exterior housing 10*a*.

Although the air supply ducts 212, 232 are installed in the valves 219, 239, respectively, in the above example, it is not always the case that the valves 219, 239 need to be installed in the air supply ducts 212, 232, respectively. For example, there may be a three-way valve installed in the air supply path 200 of the dryer 1. In this case, one entrance of the three-way valve may be connected to the air inflow duct 202, another entrance to the first air supply duct 212, and the other entrance to the second air supply duct 232, and depending on the operation of the three-way valve, the first air supply duct 212 may be connected to the air inflow duct 202 or the second air supply duct 232 may be connected to the air inflow duct 202. Accordingly, the air flowing into the air inflow path 201 may be delivered selectively to the first air inlet 120 or to the second air inlet 140.

Figure 7:
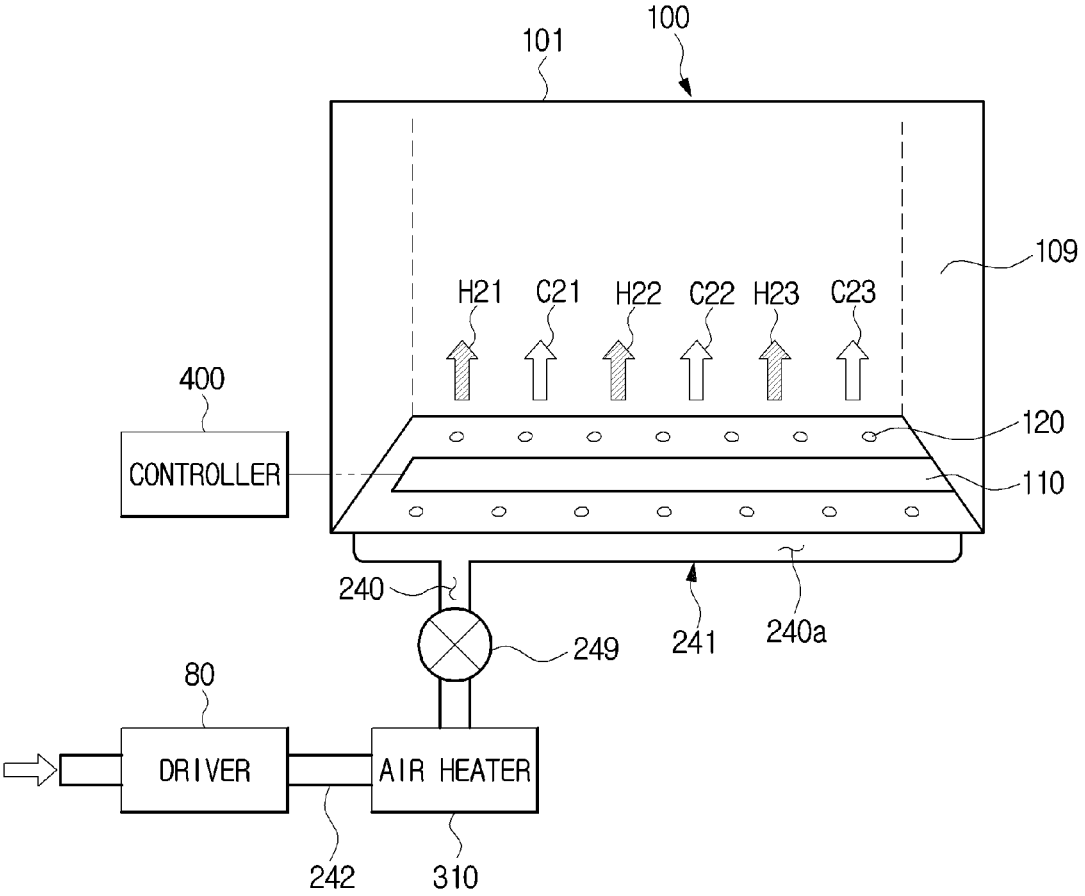
FIG. 7 shows a second embodiment of a container and an air supply path.

FIG. 7 shows a second embodiment of a container and an air supply path.

In the second embodiment, as shown in FIG. 7, the air supply path 200 may include a single air supply path 240.

The single air supply path 240 may be implemented using an air supply duct 241 extending from the inside of the exterior housing 10*a* to the bottom of the container 100.

An opening (not shown) is formed at one end 242 of the air supply duct 241, and the air inside the exterior housing 10*a* flows in through the opening by the operation of the driver 80. The other end 240*a* of the air supply duct 241 is formed underneath the container 100 such that the air delivered through the air supply path 240 may be delivered to the first air inlet 120 on the bottom of the container 100.

In an embodiment, the other end 240*a* of the air supply duct 241 may be formed to include an opening of a size corresponding to a region where the plurality of first air inlets are arranged, to allow air to flow into all of the first air inlets.

In an embodiment, the air supply duct 241 may have a valve 249 installed therein, which is opened or shut under the control of the controller 400 to enable or disable the air flowing in through the opening to be delivered to the first inlet 120 of the container 100 along the air supply path 240.

In an embodiment, the air supply duct 241 may have the air heater 310 formed therein. The air heater 310 heats the air flowing inside the air supply duct 241, as described above. Like what is shown in FIG. 2, the air heater 310 may include the coil 312 for supplying heat energy to the moving air and the air heater duct 314 having the coil 312 installed therein.

The air heater 310 may or may not heat, i.e., selectively heat the air delivered through the air supply duct 241 under the control of the controller 400. Accordingly, non-heated air c21, c22, c23 or heated air H21, H22, H23 may be discharged into the receiving space 109 of the container 100 through the first inlet 120.

In an embodiment, the air heater 310 may be controlled to not perform heating operation if the electrode part 110 produces the electric field E or to perform heating operation if the electrode part 110 is not producing the electric field E. Alternatively, the air heater 310 may perform the heating operation regardless of operation of the electrode part 110.

When the electrode part 110 produces the electric field E under the control of the controller 400 and the non-heated air c21, c22 and c23 flows into the receiving space 109, like the occasion when the air is supplied through the first air supply path 210, the non-heated air c21, c22 and c23 contains moisture separated from the object 9 by the electric field E and the air containing the moisture c21, c22, and c23 moves to the first discharge path 260 by the operation of the blower fan 92.

When the electrode part 110 produces the electric field E under the control of the controller 400 and the heated air H21, H22, H23 flows into the receiving space 109 of the container 100 through the first air inlet 120, the moisture in the object 9 may be evaporated by both the electric field E and the heated air H21, H22, H23. As described above, the heated air with moisture H21, H22, H23 moves to the first discharge path 260 by the operation of the blower fan 92.

As shown in FIG. 2, the first discharge path 260 may be arranged inside the exterior housing 10*a*. The first discharge path 260 may be provided for at least one of the air c11 to c14, c21 to c23, H21 to H23 flowing in through the first inlet 120 and the air H11 and H12 flowing in through the second air inlet 140 to be discharged out of the container 100.

In an embodiment, at one end of the first discharge path 260, the first discharge port 260*a* may be arranged ahead of the container 100, which is opened to the inside of the receiving space 109 of the container 100. More particularly, the first discharge port 260*a* may be arranged in the bottom front of the container 100. For example, the first discharge port 260*a* may be implemented using an opening formed in the bottom of the front frame 170.

In an embodiment, the grill 282 may be installed in the first discharge port 260*a*. The grill 282 may prevent the object 9 from being thrown into the first discharge port 260*a* and the first discharge path 260.

In some embodiments, a filtration unit 280 may be further arranged in the first discharge path 260 to filter out foreign materials from the air to be discharged.

The filtration unit 280 may include a filtration case 281 and a filter 283 arranged inside the filtration case 281. The filter 283 may filter out foreign materials from the air flowing into the first discharge path 260.

The air flowing into the first discharge path 260 may be delivered to the receiving space of the exterior housing 10*a*, e.g., to the space in the bottom of the container 100, or to the second discharge path 262, by the operation of the blower 90. The air delivered to the receiving space of the exterior housing 10*a* may be delivered to a terminal path 201 and then delivered to the first air supply path 210 or the second air supply path 230 by the operation of the valves 219, 239.

The blower 90 may include the blower fan 92 and a blower case 93.

The blower fan 92 may be coupled with a shaft member 83 extending from the rotation axis of the driver 80 and may rotate by the operation of the driver 80. The air moving into the first discharge path 260 by the operation of the blower fan 92 may be delivered to the terminal path 201 or to the second discharge path 262. Furthermore, the air inside the first discharge path 260 is moved out by the operation of the blower fan 92, and accordingly, the air inside the container 100 is moved to the first discharge path 260.

The second discharge path 262 may be implemented using a second discharge path duct 264. The second discharge path duct 264 is installed such that one end contacts or is placed adjacent to the blower 90 and the other end is exposed to the outside. The second discharge path duct 264 has a discharge port 269 arranged at the other end, through which to discharge air.

In an embodiment, the second discharge path duct 264 may have an opening formed at one end to allow the air delivered from some regions of the blower 90 to flow in. Accordingly, some of the air discharged by the blower 90 flows into the second discharge path 262 through the opening and some other air is delivered to the receiving space of the exterior housing 10*a*.

The driver 80 may be implemented using e.g., a motor, which may include various types of motors such as a direct current (DC) motor, an alternate current (AC) motor, a brushless DC (BLDC) motor, etc., that may be considered by the designer. By the operation of the driver 80, the blower fan 92 is rotated, allowing air to flow into the dryer 1.

In an embodiment, a container rotator 70 may be arranged in the receiving space of the dryer 1. The container rotator 70 may produce power to rotate the container 100 and deliver the power for the container 100 to be rotated in at least one direction R1 or R2.

In an embodiment, the container rotator 70 may include a driver 85 (see FIG. 14), a rotary member 73 rotating by the operation of the driver 85, and a moving member 71 moving with the rotation of the rotary member 73.

The driver 85 converts electric energy to mechanical energy under the control of the controller 400, thus obtaining rotational force in at least one direction.

The rotary member 73 receives the rotational force from the driver 85 and rotates according to the received rotational force. The rotary member 73 may be implemented using e.g., a pulley or a gear.

The moving member 71 is mounted on the rotary member 73 and moved with the rotation of the rotary member 73. The moving member 71 may be implemented using e.g., a cable, a wire, a belt, and/or a chain.

The moving member 71 may be provided to contact the outer surface of the container 100, e.g., the rotary drum 101, as shown in FIG. 2. When the moving member 71 moves with rotation of the rotary member 73, the friction between the moving member and the rotary drum 101 makes the rotary drum 101 rotated in response to the movement of the moving member 71.

In an embodiment, at least one supporting roller 77 may be further provided underneath the container 100 to facilitate smooth rotation of the container 100 in response to the movement of the moving member 71. The at least one supporting roller 77 may be in contact with the container 100 at a point and may be rotated in response to the rotation of the container 100.

Although the moving member 71 and rotary member 73 are used to rotate the container 100 in FIG. 2, how to rotate the container 100 is not limited thereto.

For example, the container 100 may be provided to make direct contact with the gear or pulley, and may be rotated in response to the rotation of the gear or the pulley due to the friction between the gear or pulley and the container 100.

In another example, a rotation shaft member may be coupled to the rotation axis z of the container 100 and to the driver that obtains rotational force, in which case the container 100 may also be rotated by the rotation of the rotation shaft member by the operation of the driver.

The container 100 may be rotationally installed inside the exterior frame 10*a* of the dryer 1 in various methods that may be considered by the designer.

Figure 8:
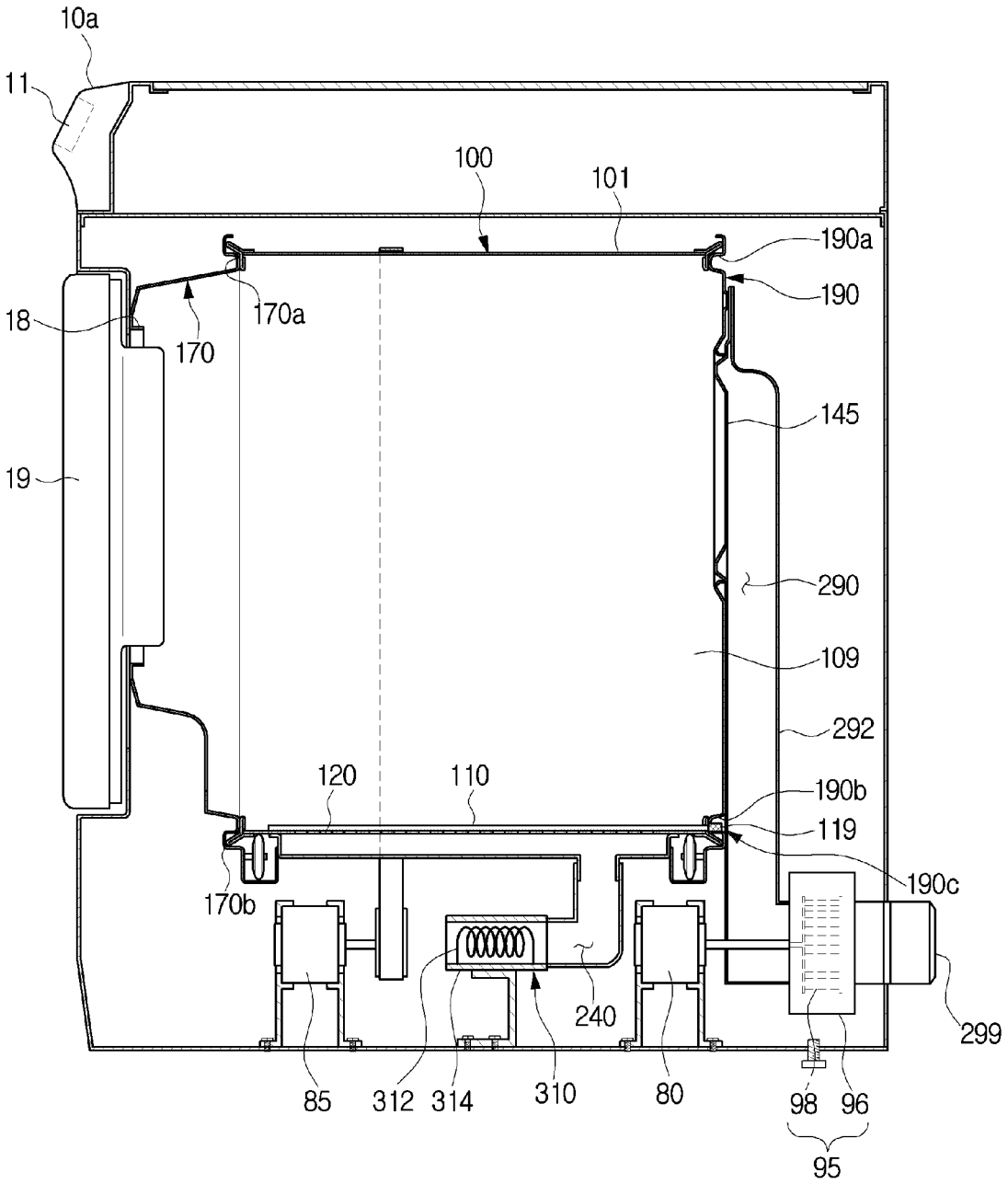
FIG. 8 shows a side cross-sectional view for explaining an embodiment in which a discharge path is formed on the rear side.
Figure 9:
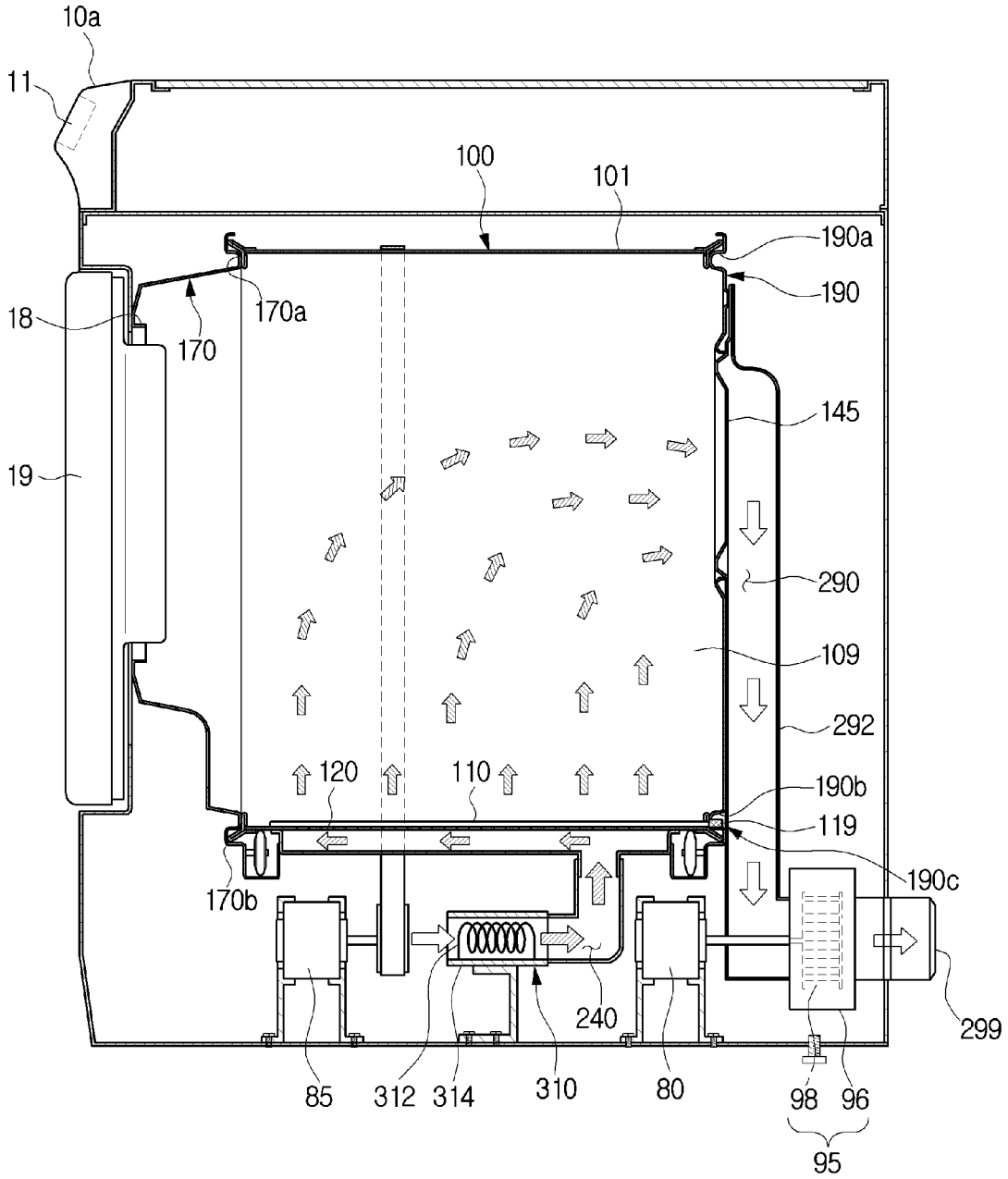
FIG. 9 shows an example of discharged airflow in a case that a discharge path is formed on the rear side.

FIG. 8 shows a side cross-sectional view for explaining an embodiment in which a discharge path is formed on the rear side, and FIG. 9 shows an example of discharged airflow in a case that a discharge path is formed on the rear side.

Referring to FIG. 8, in an embodiment, a discharge path 290 may be arranged in the back of the container 100.

One end of the discharge path 290 may be mounted in the back of the container 100, e.g., on the rear frame 190 and the other end may be implemented using a discharge duct 292 exposed to the outside.

Specifically, the discharge duct 292 may be connected to the second discharge port 145 arranged on the back of the container 100, and the air discharged from the receiving space 109 of the container 100 may flow into the discharge duct 292 through the second discharge port 145.

In this case, the second discharge port 145 may be one formed on the rear frame 190. In some embodiments, one or more second discharge ports 145 may be formed on the rear frame 190.

In an embodiment, the second discharge port 145 may be formed in a region of the rear frame 190, and the region may be located in the upper portion of the rear frame 190 as shown in FIG. 8. In other words, the air in the receiving space 109 of the container 100 is discharged from the upper portion of the container 100 to the outside of the container 100.

A blower 95 may be installed in the discharge duct 292. The blower 95 may include a blower fan 96 and a blower case 98.

The blower fan 96 may be coupled with the rotation shaft member of the driver 80 and rotated by the operation of the driver 80. As shown in FIG. 9, air of the receiving space 109 of the container 100 flows into the discharge duct 292 as the blower fan 96 rotates. The air flowing into the discharge duct 292 may be moved toward the blower fan 96 by the operation of the blower fan 96 and be delivered via the blower 95 to a discharge port 299 formed at the other end of the discharge duct 292. Accordingly, the air in the receiving space 109 of the container 100 may be discharged out of the dryer 1.

As described above, when the discharge path 290 is located in the upper portion of the rear frame 190, the air c11 to c14, c21 to c23, H11, H12, H21 to H23 delivered into the container 100 may be relatively more appropriately discharged to the outside, and accordingly, the evaporated moisture may be relatively effectively discharged to the outside.

If the discharge path 290 is located in the back of the container 100, in an embodiment, the air supply path 200 may include the first air supply path 210 and the second air supply path 230 as shown in FIGS. 4 to 6.

In another embodiment, if the discharge path 290 is located in the back of the container 100, a single air supply path 240 may be included as shown in FIGS. 7 and 8. In the case that the discharge path 290 is arranged in the back of the container 100 as described above, the container 100 may lack enough space to install the air supply path 200 in the back of the container 100. To secure the space to install the air supply path 200, the air supply path 240 may be in the singular and may be installed at the bottom of the container 100.

As described above in connection with FIG. 7, the single air supply path 240 may have the air heater 310 installed therein to have the coil 312 for supplying heat energy to air according to an applied voltage/current. The end 240*a* of the air supply path 240 may be expanded and installed for the air to be appropriately delivered to the first air inlet 120. In this case, the end 240*a* of the air supply path 240 may expand in the longitudinal direction of the container 100 depending on the arrangement of the first air inlets 120.

Furthermore, in an embodiment, as shown in FIG. 8, the dryer 1 may be further equipped with the first driver 85 implemented with a motor, the rotary member 73 rotated by the operation of the first driver 85, and the moving member 71 moving with the rotation of the rotary member 73 to rotate the container 100, e.g., the rotary drum 101. In some embodiments, instead of the moving member 71 and the rotary member 73, a gear or pulley in direct contact with the container 100, a driver arranged on the rotation axis of the container 100, or the like may be installed inside the dryer 1.

Even in the embodiment shown in FIGS. 7 and 8, the electric field maker 110 and the first air inlet 120 may be installed on the inner circumferential face of the container 100.

Drying operation of the dryer 1 using the electric field produced by the electrode part 110 and the air heated by the air heater 310 will now be described.

Figure 10:
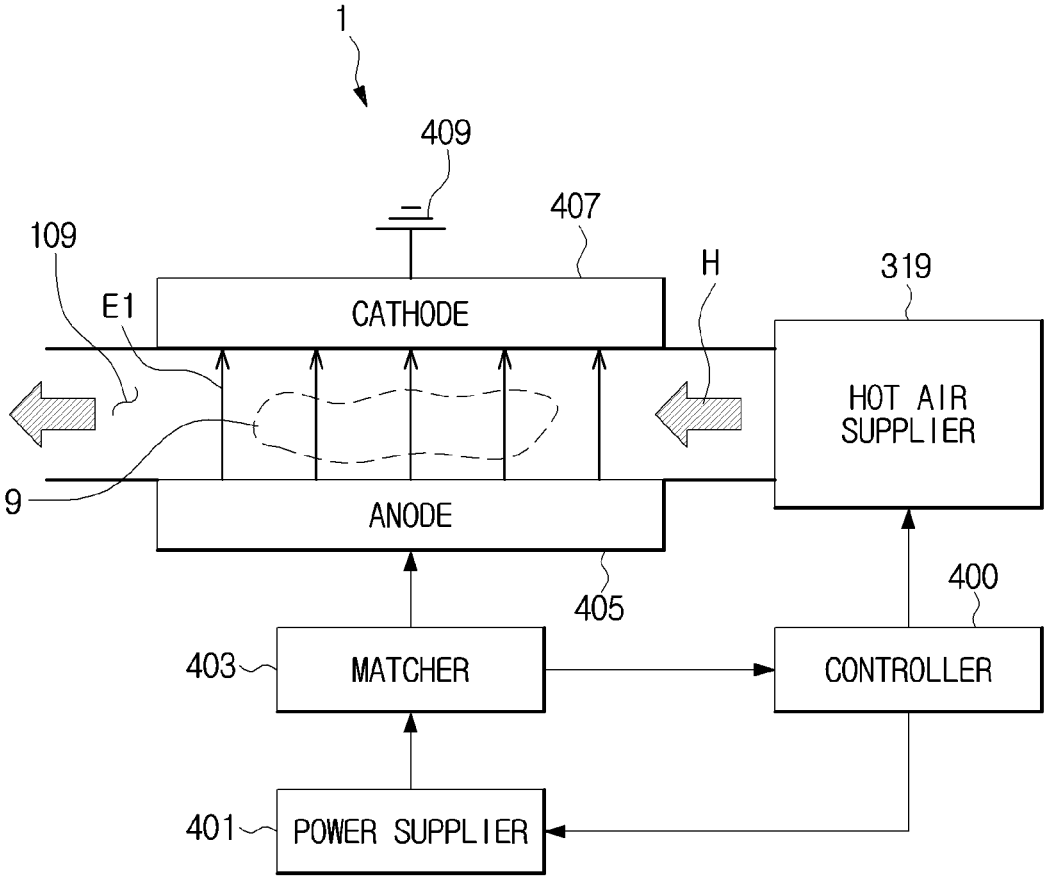
FIG. 10 is a view for explaining a drying method using electric field and hot air.

FIG. 10 is a view for explaining a drying method using electric field and hot air.

Referring to FIG. 10, the dryer 1 may include a hot air supplier 319, the controller 400, a power supplier 401, a matcher 403, an anode 405, and a cathode 407.

The hot air supplier 319 is configured to supply heated air, i.e., hot wind (or hot air) into predetermined space where the object 9 is placed, e.g., the receiving space 109 of the container 100. The hot air supplier 319 may be implemented using the air heater 310 to heat air. The air heater 310 may be installed inside the dryer 1 with a certain gap from the parts arranged to produce an electric field E1, such as the power supplier 401, the anode 405, and the cathode 407 to prevent heat from being applied to the parts. Alternatively, the air heater 310 may be installed to be adjacent to the container 100 if needed.

The anode 405 and the cathode 407 are arranged to produce the electric field E1 with a certain intensity in the receiving space 109 of the container 100.

The controller 400 generates and sends a control signal to initiate operation of the power supplier 401, and the power supplier 401 provides radio frequency (RF) power to the anode 405 by outputting an RF signal corresponding to the control signal. The RF signal output by the power supplier 401 may be sent to the anode 405.

As the RF signal is applied, the electric field E1 is produced in a direction from the anode 405 to the cathode 407 connected to the ground 409.

In an embodiment, the RF signal output by the power supplier 401 may be sent to the anode 405 via the matcher 403.

The matcher 403 may detect a state of the electric field E1 produced in the receiving space 109 and send the detected result to the controller 400. The controller 400 may control the power supplier 401 to make the electric field E1 applied to the object 9 be in the optimum state based on the detected result sent from the matcher 403.

The matcher 403 performs a function to match load impedance of a reactor with a certain resistance value. The reactor as herein used may include the object 9, the moisture contained in the object 9, and the container 100. The matcher 403 may include at least one capacitor, in which charges accumulate while the electric field E1 is produced. In this case, the amount of charges accumulated in the capacitor varies by the load impedance. Information about the amount of charges accumulated in the capacitor may be sent to the controller 400 in the form of an electric signal.

The controller 400 may determine load impedance present in the container 100 based on the information about the amount of charges accumulated in the capacitor. As the load impedance varies by the amount of object 9 and the amount of moisture contained in the object 9, the controller 400 may determine a characteristic value of the object 9, e.g., remaining moisture contents (RMC) of the object 9, based on the load impedance.

The controller 400 may control the power supplier 401 according to the RMC of the object 9. The controller 400 may also control operation of the air heater 310 based on the RMC of the object 9 if necessary.

For example, if the RMC of the object 9 belongs to a predetermined first range, the controller 400 may control the power supplier 401 to apply the electric field E1 to the object 9, and if the RMC of the object 9 belongs to a predetermined second range, the controller 400 may control the air heater 310 to supply heated air, i.e., hot air H, to the object 9.

The controller 400 may also control the air heater 310 not to operate while the electric field E1 is applied to the object 9. In other words, the controller 400 may control the air heater 310 not to heat the air while sending the control signal to the power supplier 401. For example, the controller 400 may turn off a switch (not shown) arranged between the air heater 310 and a power source (not shown) to prevent power from being applied to the air heater 310, thereby preventing the air heater 310 from heating air.

The controller 400 may also control the power supplier 401 not to operate while the air heater 310 is operating, thereby preventing the electric field E1 from being produced while the hot wind H is supplied.

In other words, the controller 400 may selectively control the power supplier 401 and the air heater 310 according to the RMC of the object 9 determined based on the information sent from the matcher 403. With the selective operation between the power supplier 401 and the air heater 310, the object 9 may be dried more efficiently.

The parts provided to produce the electric field E1, such as the power supplier 401, the matcher 403, the anode 405, and/or the cathode 407 may be heated while working. In an embodiment, the dryer 1 may further include a cooling system to quickly deliver the heat released from the parts to the outside or reduce the temperature of the parts.

An embodiment of the dryer 1 for performing the drying operation will now be described in more detail.

Figure 11:
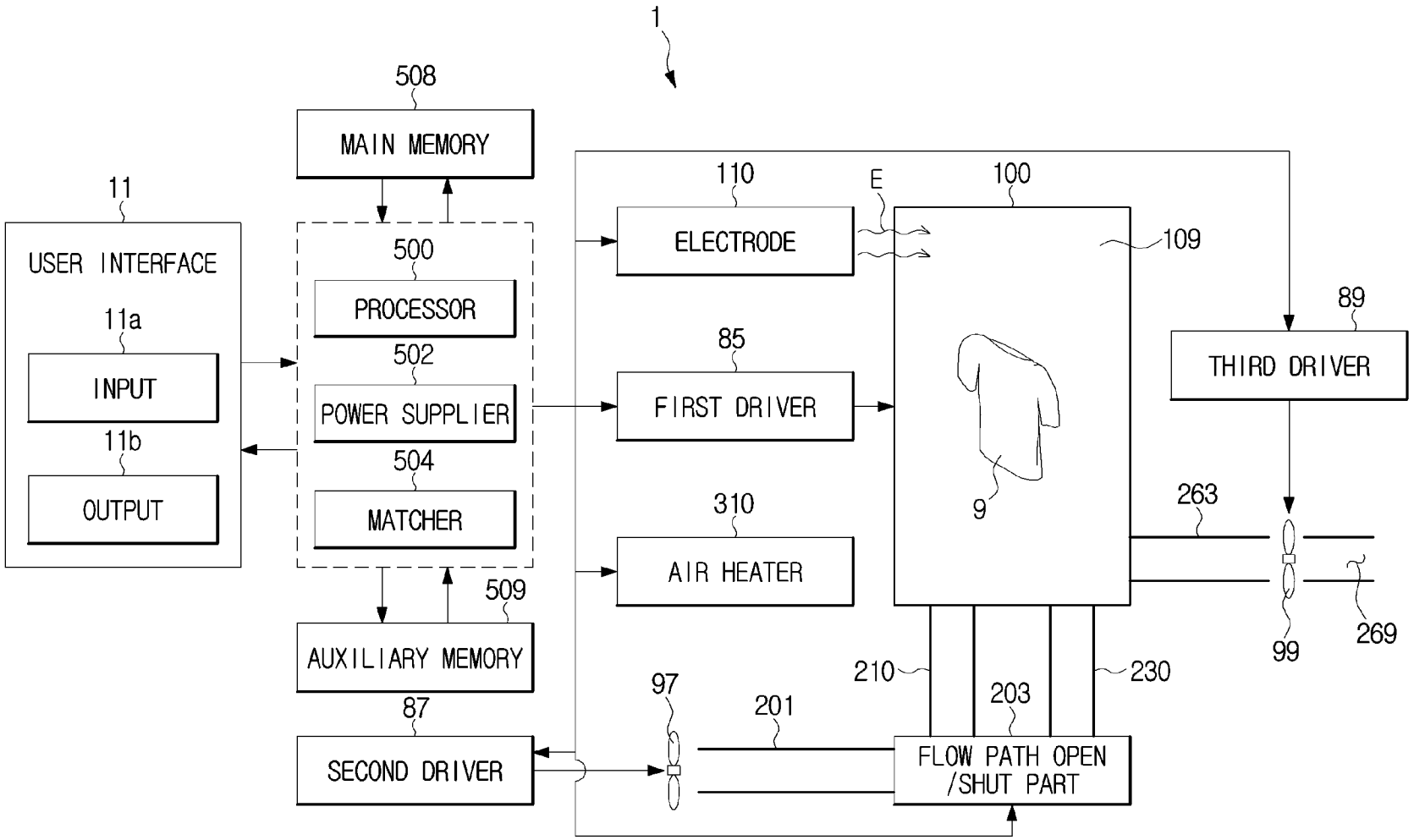
FIG. 11 is a detailed control block diagram of a dryer, according to an embodiment of the present disclosure.

FIG. 11 is a detailed control block diagram of a dryer, according to an embodiment of the present disclosure.

As shown in FIG. 11, the dryer 1 may include a user interface 11, a processor 500, a power supplier 502, a matcher 504, an electrode part 110, at least one driver 85, 87, 89, the air heater 310, the container 100 with the receiving space 109 formed therein, flow paths 201, 210, 230, 263, 269, etc.

The user interface 11 may include an input 11*a* for receiving certain commands from the user and/or an output 11*b* for providing various kinds of information to the user.

When the user manipulates the input 11*a* of the user interface 11, the input 11*a* outputs and sends an electric signal corresponding to the user's manipulation to the processor 500.

The processor 500 may control general operation of the dryer 1. The processor 500 may be implemented using at least one semiconductor chip, circuits, circuit parts and/or many different related parts. The processor 500 may include e.g., a central processing unit (CPU) and/or a micro controller unit (MCU).

The power supplier 502 may supply power to the electrode part 110. For example, the power supplier 502 may generate an RF signal and send the RF signal to the electrode part 110 under the control of the processor 500.

The matcher 504 may perform a function to match load impedance of the reactor with a certain resistance value, as described above.

The power supplier 502 and the matcher 504 may be implemented using different circuits and/or circuit parts.

The processor 500 may control the power supplier 502 to generate an RF signal. The RF signal may be sent to the electrode part 110, which may in turn produce a certain electric field E in the receiving space 109 in response to the received RF signal.

Furthermore, the processor 500 may control the power supplier 502 to block the power from being applied to the electrode part 110, according to the user's manipulation or predetermined settings.

The processor 500 may also send a control signal to the first driver 85 provided to rotate the container 100 to enable the container 100 to be rotated or stop the rotation.

In an embodiment, if the power to be applied to the electrode part 110 is blocked, the processor 500 may control the first driver 85 to rotate the container 100, e.g., the rotary drum 101 at the same time with or after the blockage of power.

The processor 500 may also send a control signal to the second driver 87 provided to rotate the first blower fan 97 to enable the first blower fan 97 to be rotated. The first blower fan 97 may be a blower fan provided to be adjacent to the air inflow path 210. As the first blower fan 97 rotates, air flows into the air inflow path 201, and the air moves to the receiving space 109 through at least one of the first and second air inflow paths 210 and 230.

The processor 500 may control the air heater 310 to heat the air flowing into the air inflow path 201. In this case, the air heater 310 may be configured to heat the air delivered to the receiving space 109 through the second inflow path 230 among the air flowing into the air inflow path 201.

In an embodiment, when the container 100 starts rotating, the processor 500 may control the second driver 87 and the air heater 310 in response to the start of rotation of the container 100, to supply heated air into the container 100.

For example, the processor 500 may control the second driver 87 and the air heater 310 to supply heated air into the container 100 at the same time as the container 100 starts rotating. In this case, the processor 500 may be configured to control the container 100 to be rotated as soon as the power to the electrode part 110 is blocked, and control the second driver 87 and the air heater 310 simultaneously with the start of rotation of the container 100.

Furthermore, in another example, the processor 500 may control the second driver 87 and the air heater 310 to supply heated air into the container 100 after the container 100 starts rotating. In this case, the processor 500 may be configured to control the container 100 to be rotated after the power to the electrode part 110 is blocked, and control the second driver 87 and the air heater 310 after the start of rotation of the container 100.

The processor 500 may also operate the third driver 89 by sending a control signal to the third driver 89 provided to rotate the second blower fan 99. The second blower fan 99 may be installed in the discharge path 263. The discharge path 263 may include the first discharge path 260 and the second discharge path 262 in the first embodiment, or include the discharge path 290 in the second embodiment. With operation of the third driver 89, the second blower fan 99 rotates, and accordingly, the air inside the receiving space 109 is discharged along the discharge path 263 to the outside through the discharge port 269.

The processor 500 may control a flow path open/shut part 203 to be opened or shut. In an embodiment, the flow path open/shut part 203 may include the first valve 219 and the second valve 239. In some embodiments, the flow path open/shut part 203 may include a three-way valve. With the operation of the flow path open/shut part 203, the air is delivered to the receiving space 109 through one of the first and second air supply paths 210 and 230.

To assist the operation of the processor 500, the dryer 1 may further include a main memory device 508 and an auxiliary memory device 509.

The main memory device 508 and the auxiliary memory device 509 may temporarily or non-temporarily store various kinds of data required to operate the dryer 1.

The main memory device 508 is implemented with a read only memory (ROM) or a random access memory (RAM).

The auxiliary memory device 509 is implemented with a semiconductor storage device, a magnetic disk storage device, and/or a magnetic drum storage device.

The auxiliary memory device 509 may store data regarding various references required to operate at least one of the electrode part 110, the air heater 310 and the first to third drivers 85, 87, and 89, e.g., data of first to fifth references. The data of first to fifth references is sent to the processor 500 directly by the operation of the processor 500 or through the main memory device 508. The processor 500 may generate a control signal for at least one of the electrode part 110, the air heater 310, and the first to third drivers 89 based on the data of first to fifth references, and send the control signal to a corresponding part.

Various embodiments of a process of controlling the respective parts 85, 87, 89, 100, 203, and 310 based on the first to fifth references will now be described.

For convenience of explanation, based on the dryer 1 with the first and second air supply paths 210 and 230 arranged therein and the first discharge port 260*a* arranged on the bottom front of the container 100, operation of the processor 500 will be described. The following operation of the processor 500, however, is applied not only to the embodiments of the dryer 1. The operation of the processor 500 may be applied for an occasion where the second discharge port 145 and/or the single air supply path 240 is installed equally or with some modification.

Figure 12:
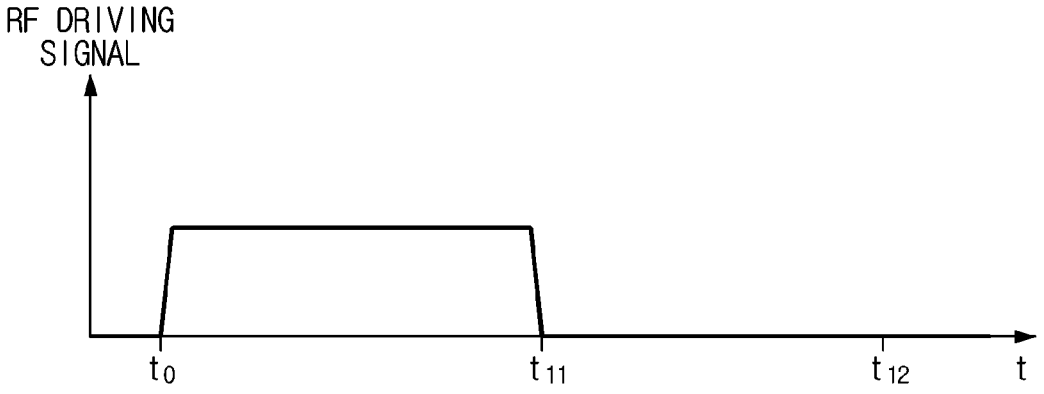
FIG. 12 is a view for explaining an embodiment of operation changes of an electrode part over time.
Figure 13:
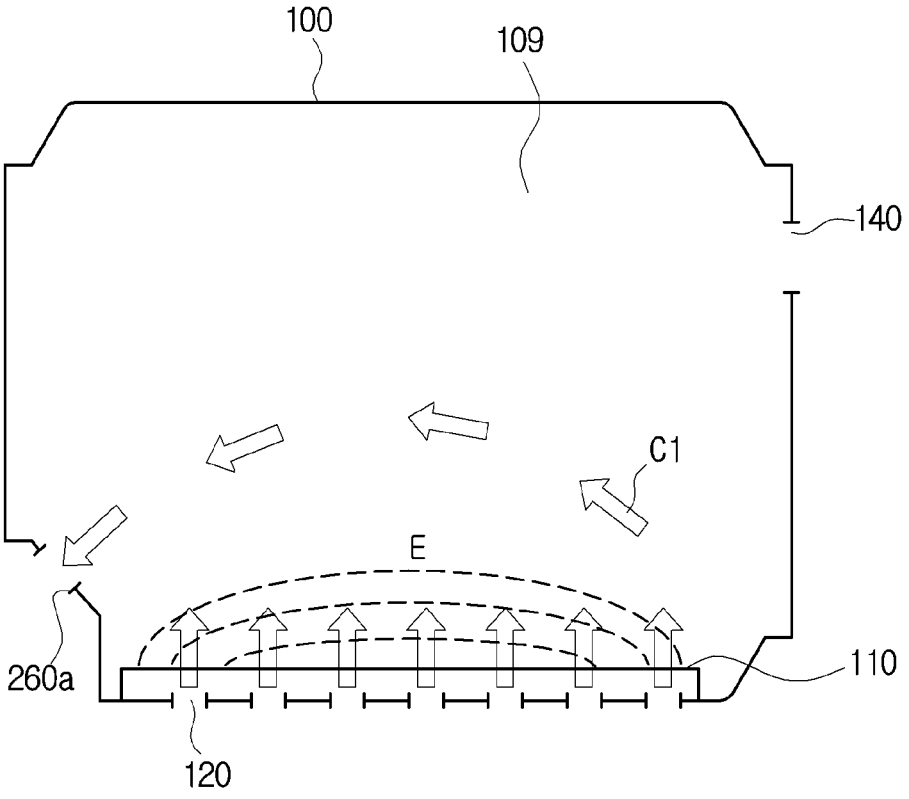
FIG. 13 is a first view for explaining operation of a dryer, according to an embodiment of the present disclosure.
Figure 14:
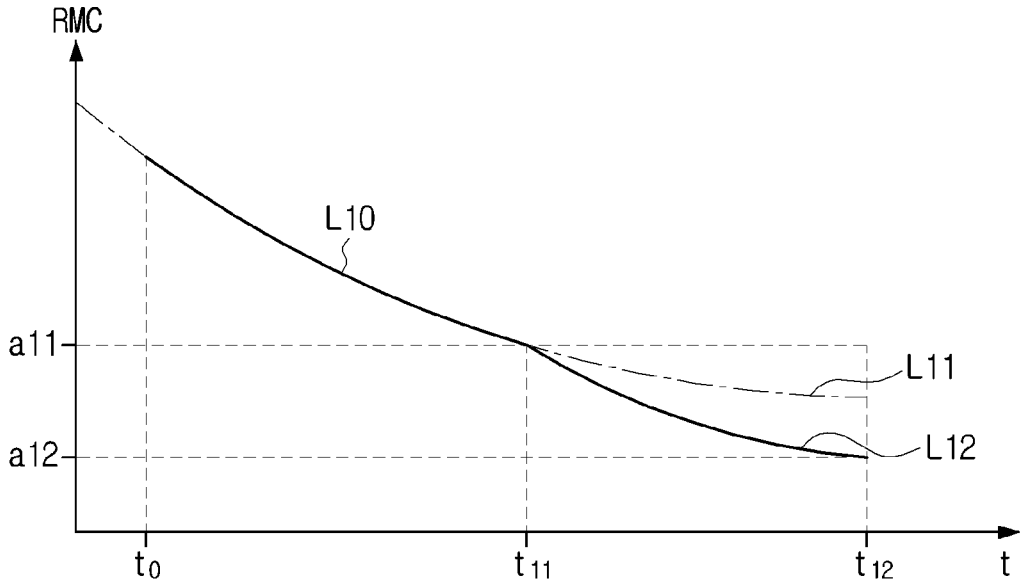
FIG. 14 is a view for explaining an example of a change in remaining moisture content (RMC) over time.
Figure 15:
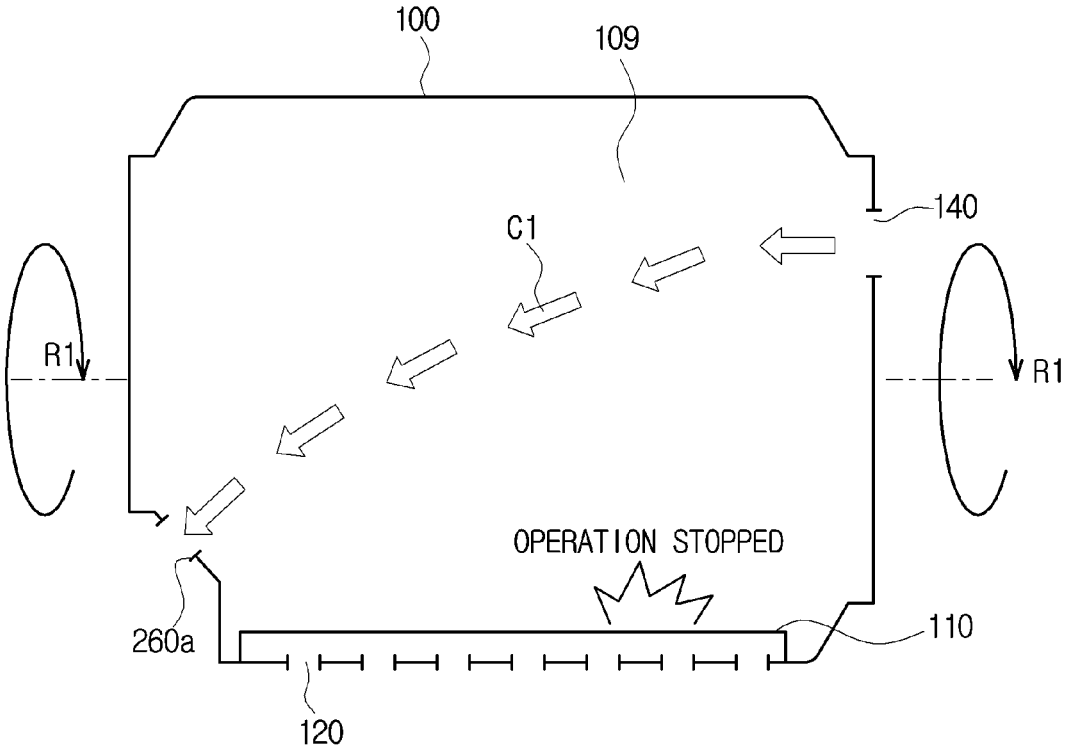
FIG. 15 is a second view for explaining operation of a dryer, according to an embodiment of the present disclosure.
Figure 16:
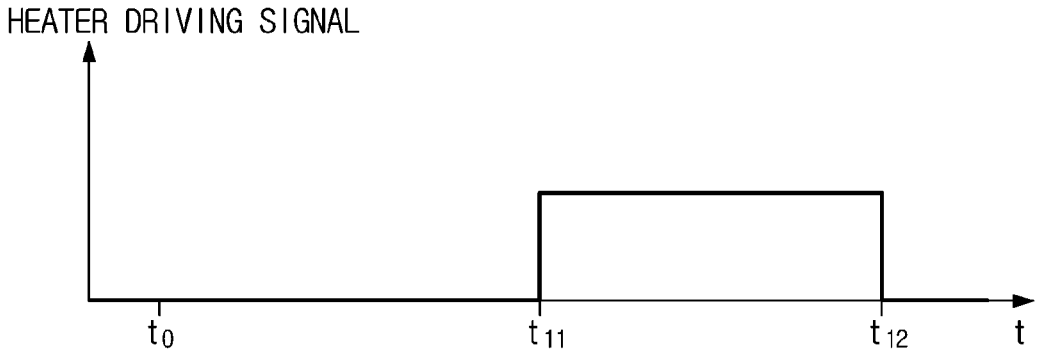
FIG. 16 is a view for explaining an embodiment of operation changes of an air heater over time.
Figure 17:
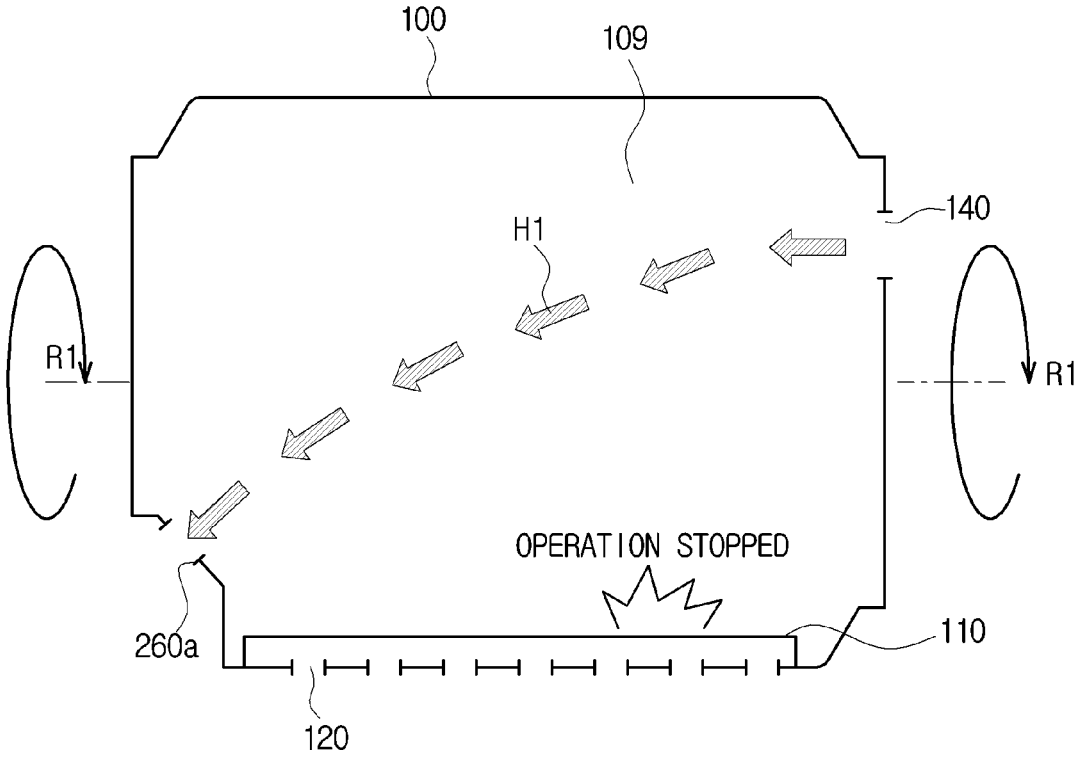
FIG. 17 is a third view for explaining operation of a dryer, according to an embodiment of the present disclosure.

FIG. 12 is a view for explaining an embodiment of operation changes of an electrode part over time, FIG. 13 is a first view for explaining operation of a dryer, according to an embodiment of the present disclosure, and FIG. 14 is a view for explaining an example of a change in RMC over time. FIG. 15 is a second view for explaining operation of a dryer, according to an embodiment of the present disclosure, FIG. 16 is a view for explaining an embodiment of operation changes of an air heater over time, and FIG. 17 is a third view for explaining operation of a dryer, according to an embodiment of the present disclosure.

In an embodiment, the processor 500 may apply a voltage/current to the electrode part 110 in response to the user's command to start drying through the user interface 11. Accordingly, as shown in FIGS. 12 and 13, the electrode part 110 starts operation at t0 and an electric field E with a certain intensity is produced inside the receiving space 109.

In an embodiment, the processor 500 may control the first driver 85 to rotate the container 100 up to one round so that the electrode part 110 may be in the right place, e.g., almost in the bottom direction of the dryer 1 before a voltage/current is applied to the electrode part 110.

The processor 500 may determine a characteristic value of the object 9, e.g., the RMC of the object 9 and determine an operating condition, e.g., an RF signal output condition, of the electrode part 110 based on the RMC, before the electrode part 110 produces the electric field E with a certain intensity. The RMC of the object 9 may be obtained based on e.g., load impedance that may be estimated by the matcher 504.

The processor 500 may control the flow path open/shut part 203 to connect the first air supply path 210 to the air inflow path 201 at the same time with the operation of the electrode part 110 or before or after the operation of the electrode part 110.

Once the air inflow path 201 is connected to the first air supply path 210, the processor 500 may control the second driver 87 to deliver the air to the receiving space 109 of the container 100 via the air inflow path 201 and the first air supply path 210. Since the air heater 310 is not arranged in the first air supply path 210, the air c1 delivered to the receiving space 109 via the air inflow path 201 and the first air supply path 210 may be low temperature air.

The air c1 delivered to the receiving space 109 via the air inflow path 201 and the first air supply path 210 may be delivered to the receiving space 109 through the first air inlet 120 as shown in FIG. 13. Since the first air inlet 120 is formed near the electrode part 110, the air delivered to the receiving space 109 through the first air inlet 120 carries the moisture evaporated by the electric field E to the discharge port 260*a*. The air containing the moisture, which goes into the discharge port 260*a*, may be delivered to the discharge path 263.

The first driver 85 is controlled not to operate and the rotating operation of the container 100 is blocked, while the electrode part 110 is operating. As the container 100 is staying put, the object 9 may be placed stably around the electrode part 110. Furthermore, the electrode part 110 may also generate the electric field E constantly and stably.

In an embodiment, the processor 500 may determine whether an effective voltage Vrms of the matcher 403 exceeds a predetermined reference value. The predetermined reference value may be arbitrarily determined by the designer or the user. The effective voltage Vrms may increase according to a dried extent of the object 9. If the effective voltage Vrms exceeds the predetermined reference value, the processor 500 may control the power supplier 502 to lower its output. This may prevent overvoltage from being applied to the electrode part 110.

When the electric field E is produced from the electrode part 110, the moisture contained in the object 9 is evaporated by the electric field E and accordingly, the RMC of the object 9 decreases as in a curve I10 shown in FIG. 14.

After the lapse of a certain time after the drying process on the object 9 based on the electric field E begins, the processor 500 may determine whether the RMC of the object 9 corresponds to a predetermined first reference. The certain time may be determined in advance by the designer or the user, or may be arbitrarily set by the processor 500. The first reference may include e.g., a predetermined first reference value a11 or an approximate value of the first reference value a11 to be compared with the RMC of the object 9. The first reference value a11 may be defined as e.g., an RMC of 20%.

In an embodiment, before determining whether the RMC of the object 9 corresponds to the first reference value a11, the processor 500 may block the voltage/current applied to the electrode part 110 to stop operation of the electrode part 110.

In an embodiment, if the RMC of the object 9 does not correspond to the first reference value a11, the processor 500 may continue to operate the electrode part 110.

In another embodiment, if determining that the RMC does not correspond to the first reference value a11, the processor 500 may control the container 100 to be rotated at least one round in a predetermined direction R1, as shown in FIG. 15. In this case, the electrode part 110 may be controlled not to operate. With the rotation of the container 100, the object 9 inside the container 100 may be stirred at least once.

In this case, the processor 500 may control the flow path open/shut part 203 to connect the air inflow path 201 to the second air supply path 203. Accordingly, the air c2 that has passed the second air supply path 203 flows into the receiving space 109 of the container 100 through the second air inlet 140. At this time, the air heater 310 is controlled not to operate. Accordingly, the air c2 flowing into the receiving space 109 via the second air supply path 203 may be non-heated low temperature air.

Once the rotation of the container 100 is stopped, as shown in FIGS. 12 and 14, the operation of the electrode part 110 is resumed. When the operation of the electrode part 110 is resumed, the processor 500 may determine an operating condition of the electrode part 110 again as described above, and may control the electrode part 110 to operate based on the operating condition.

If the RMC of the object 9 is determined to correspond to the first reference value a11, the processor 500 prevents the electrode part 110 from producing the electric field E at t11, as shown in FIG. 12.

Furthermore, the processor 500 controls the flow path open/shut part 203 to connect the air inflow path 201 to the second air supply path 203 at a different time or at the same time as the operation of the electrode part 110 stops, and as shown in FIG. 16, controls the air heater 310 to heat the air moving around in the second air supply path 203 at t11.

Accordingly, as shown in FIG. 17, the hot air H1 may be supplied into the receiving space 109 through the second air inlet 140 connected to the second air supply path 203. The object 9 thrown into the receiving space 109 is then dried with the hot air H1 from the first point of time t11.

Furthermore, in the case of drying the object 9 with hot air, the container 100 may resume rotating in the predetermined direction R1 under the control of the processor 500 for the first driver 85. With the rotation of the container 100, the object 9 may be moved in a random direction inside the receiving space 109 of the container 100, and accordingly, the hot air H1 may reach the object 9 more appropriately.

As the drying process based on the electric field E proceeds, the amount of water molecules contained in the object 9 decreases. The decrease in the amount of water molecules reduces the transfer efficiency of RF energy, and therefore, as in the curve I11 of FIG. 14, the drying efficiency decreases over time.

On the other hand, in a case that the electrode 110 stops operating and the object 9 is dried by hot air, such reduction in the drying efficiency due to the decrease in transfer efficiency of RF energy does not occur, so the RMC of the object 9 decreases as in a curve 112. In this case, the drying efficiency may relatively increase.

After the lapse of a certain time after the drying process by the hot air H1 begins, the processor 500 may determine whether the RMC of the object 9 corresponds to a predetermined second reference. Like what is described above, the certain time may be defined or set by the designer, the user, and/or the processor 500. The second reference may include e.g., a predetermined second reference value a12 or an approximate value of the second reference value a12 to be compared with the RMC of the object 9. The second reference value a12 may be determined based on such an RMC that may terminate the drying process. The second reference value a12 may be defined as e.g., an RMC of about 2%.

Once determining that the RMC corresponds to the second reference, the processor 500 may determine that the object 9 is sufficiently dried and stop the drying operation at t12. In other words, operations of the air heater 310, the first driver 85, and the second driver 87 may be stopped.

Figure 18:
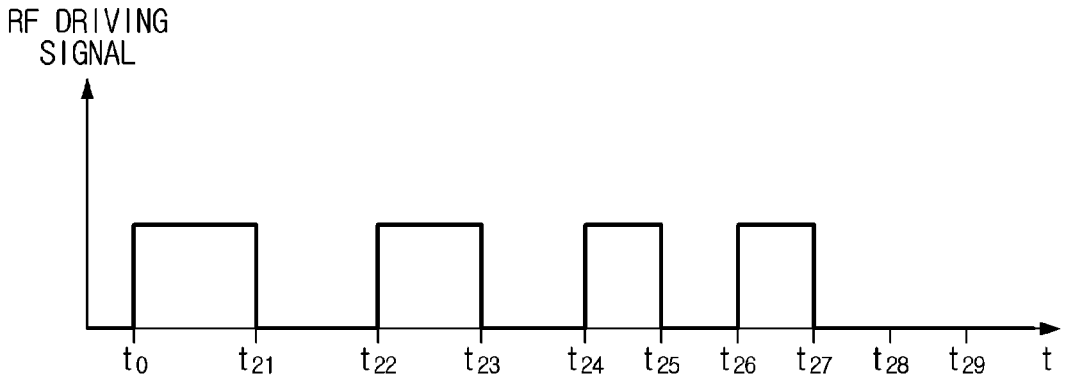
FIG. 18 is a view for explaining another embodiment of operation changes of an electrode part over time.
Figure 19:
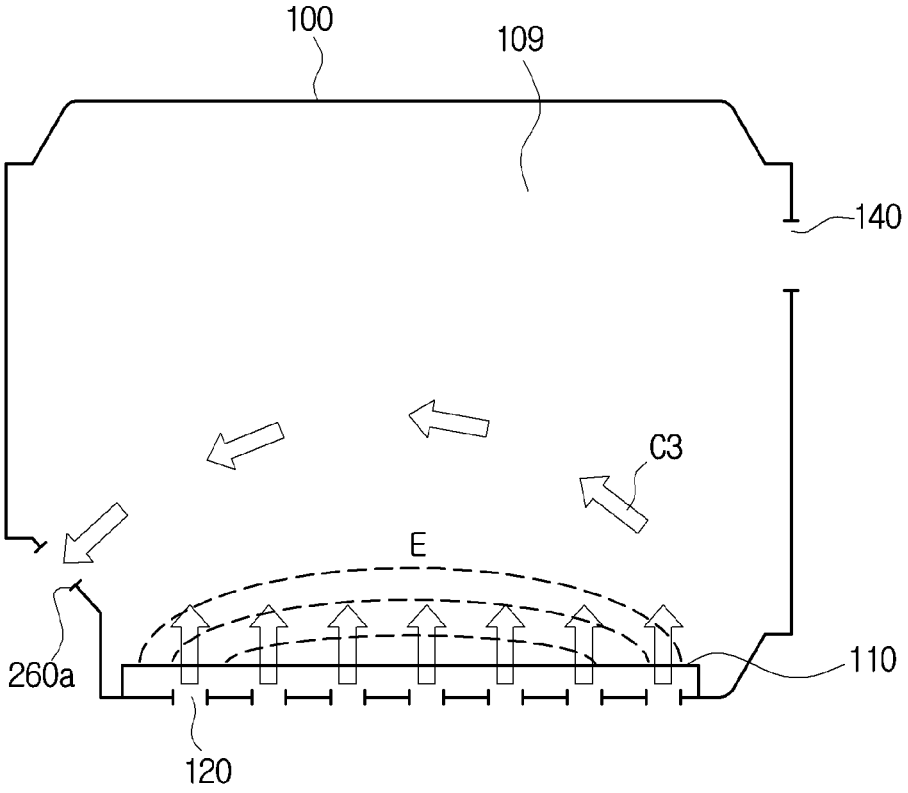
FIG. 19 is a fourth view for explaining airflow inside a dryer.
Figure 20:
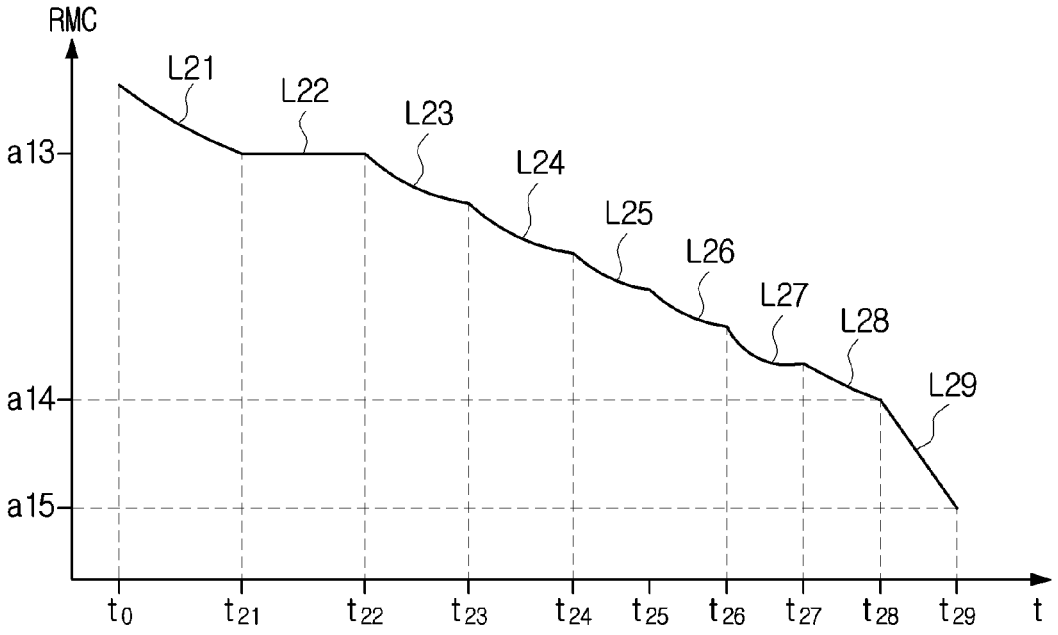
FIG. 20 is a view for explaining another example of a change in RMC over time.
Figure 21:
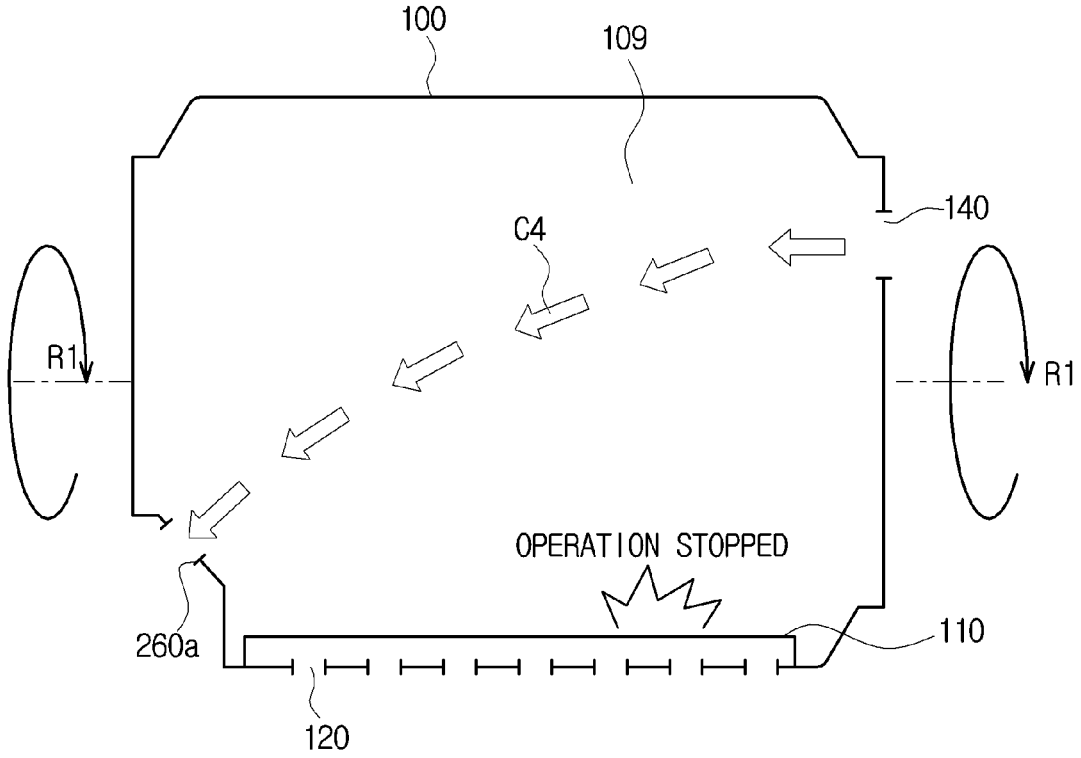
FIG. 21 is a fifth view for explaining airflow inside a dryer.
Figure 22:
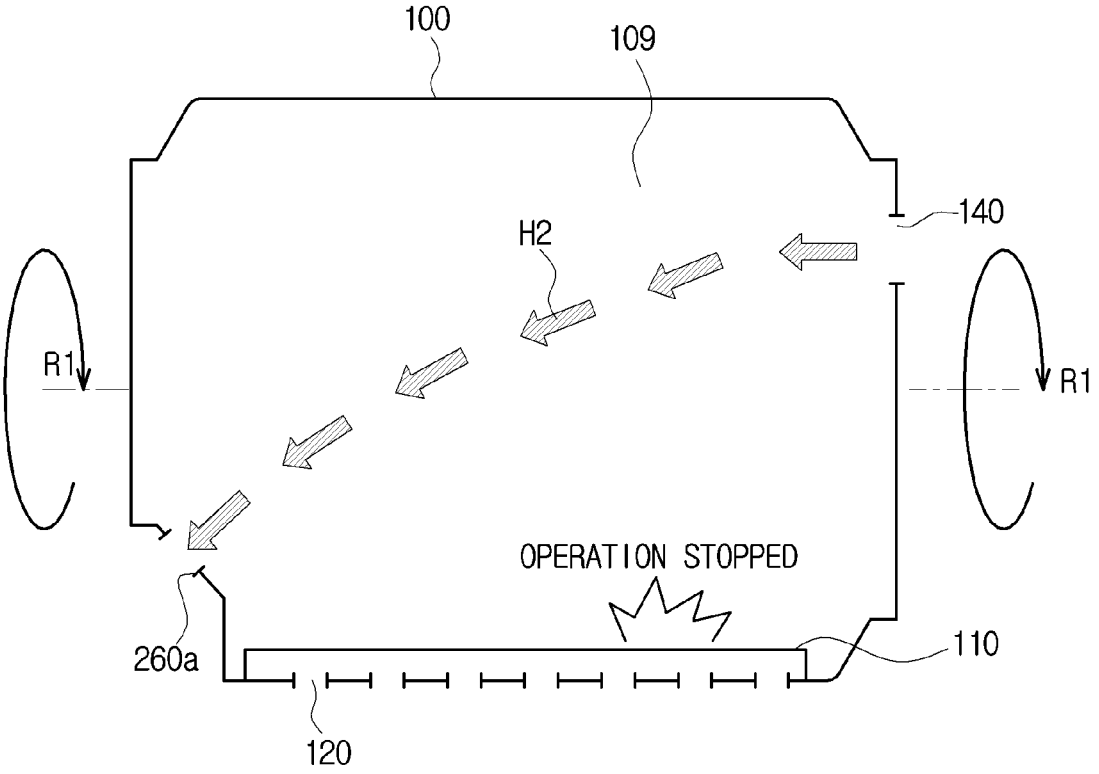
FIG. 22 is a view for explaining another embodiment of operation changes of an air heater over time.
Figure 23:
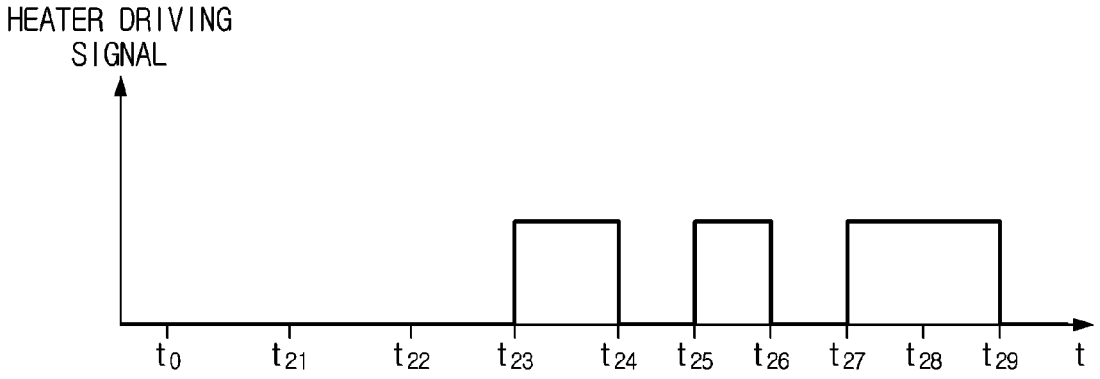
FIG. 23 is a sixth view for explaining airflow inside a dryer.
Figure 24:
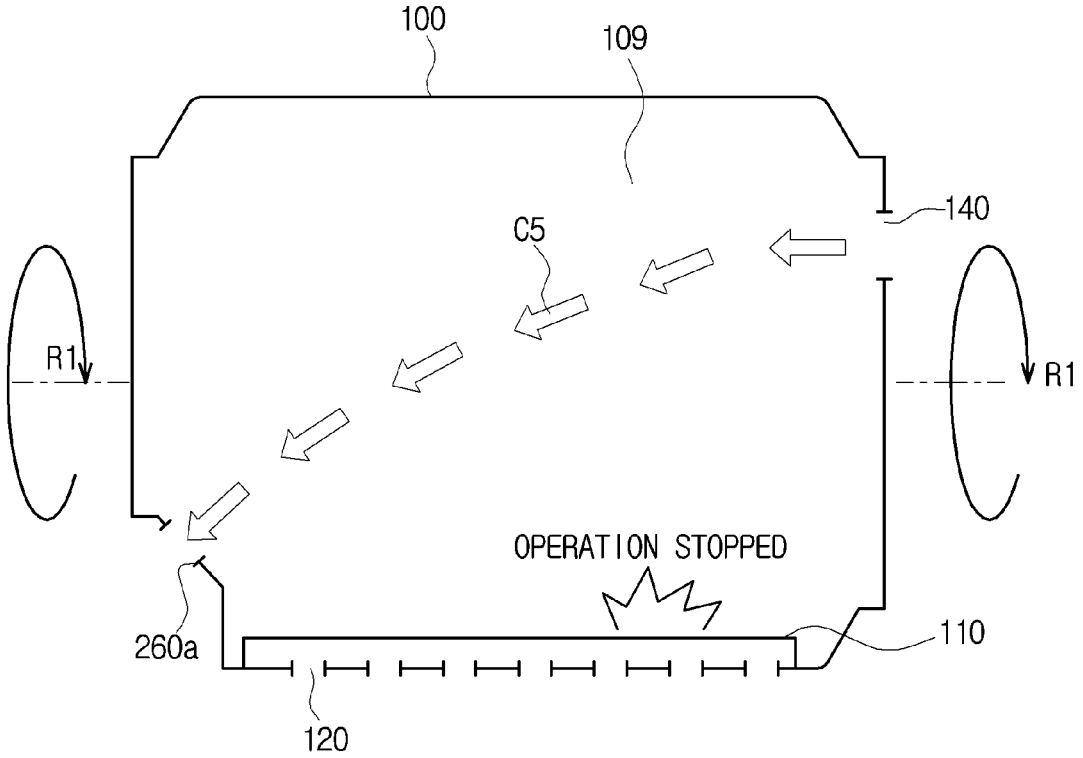
FIG. 24 is a seventh view for explaining airflow inside a dryer.
Figure 25:
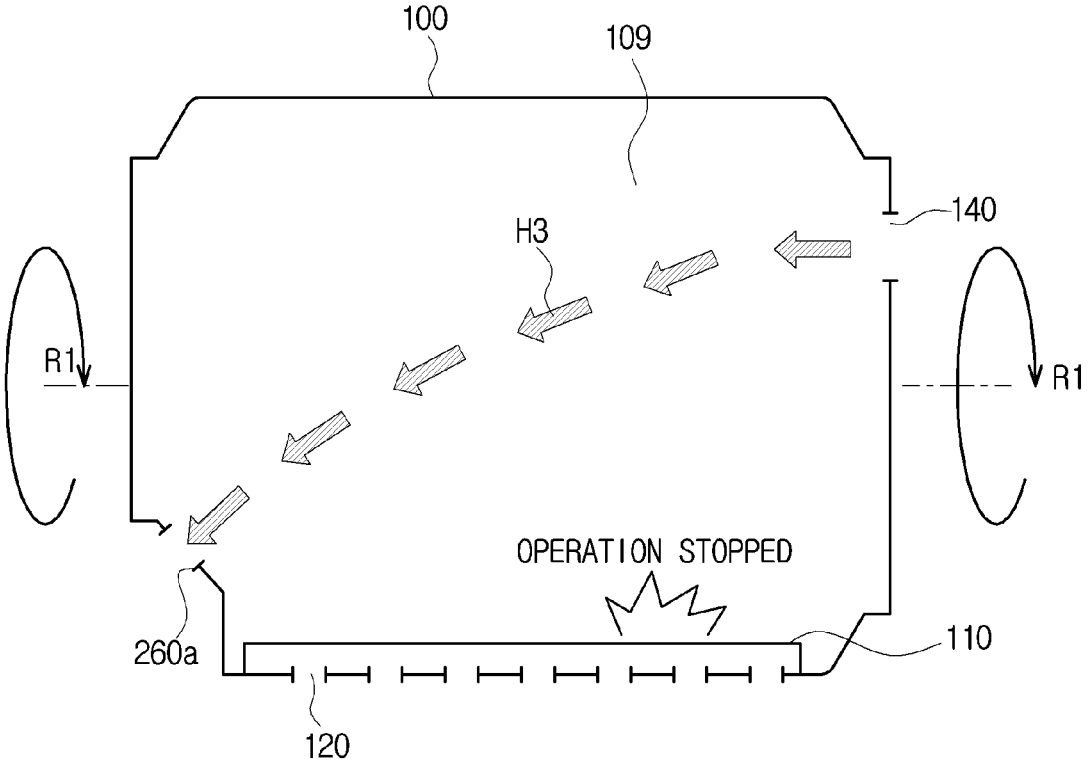
FIG. 25 is an eighth view for explaining airflow inside a dryer.

FIG. 18 is a view for explaining another embodiment of operation changes of an electrode part over time, FIG. 19 is a fourth view for explaining airflow inside a dryer, FIG. 20 is a view for explaining another example of a change in RMC over time, and FIG. 21 is a fifth view for explaining airflow inside a dryer. FIG. 22 is a view for explaining another embodiment of operation changes of an air heater over time, FIG. 23 is a sixth view for explaining airflow inside a dryer, and FIG. 24 is a seventh view for explaining airflow inside a dryer. FIG. 25 is an eighth view for explaining airflow inside a dryer.

In another embodiment, the processor 500 may first apply a voltage/current to the electrode part 110 in response to the user's command to start drying through the user interface 11. Accordingly, as shown in FIGS. 18 and 19, the electrode part 110 starts operating at t0 and the electric field E is produced inside the receiving space 109. While the electrode part 110 is operating, the container 100 is controlled not to be rotated.

Like what is described above, the processor 500 may control the container 100 to be rotated up to one round to position the electrode part 110 in a right place, and/or may determine a characteristic value of the object 9, e.g., the RMC of the object 9 and determine an operating condition of the electrode part 110 based on the RMC, before the drying operation is performed by the electrode part 110.

Furthermore, the processor 500 may control the flow path open/shut part 203 to connect the first air supply path 210 to the air inflow path 201 at the same time with the operation of the electrode part 110 or before or after the operation of the electrode part 110. Accordingly, as shown in FIG. 19, the air c3 may be discharged from the first air inlet 120 formed around the electrode part 110. The air c3 discharged through the first air inlet 120 has a relatively low temperature.

In an embodiment, the processor 500 may determine whether an effective voltage Vrms of the matcher 403 exceeds a predetermined reference value after the electrode part 110 starts operating, and may control the power supplier 502 to lower its output based on the determination.

When the electric field E is produced from the electrode part 110, the moisture contained in the object 9 is evaporated by the electric field E and accordingly, the RMC of the object 9 decreases as in a curve 121 shown in FIG. 20. The evaporated moisture may be carried in the supplied air c3 to the first discharge port 260*a*.

After the lapse of a certain time, the processor 500 may determine whether the RMC of the object 9 corresponds to a third reference. The certain time may be variously defined. The third reference may be determined based on whether the RMC of the object 9 is smaller than a predetermined third reference value a13 or an approximate value of the third reference value a13.

The third reference value a13 may be defined to be equal to or different from the first reference value a11, according to the designer's selection. The third reference value a13 may be defined as an RMC of about 40%, without being limited thereto. The third reference value a13 may be defined variously according to the user's or designer's selection.

The processor 500 may stop operation of the electrode part 110 before determining whether the RMC of the object 9 corresponds to the third reference at t21.

If determining that the RMC of the object 9 does not correspond to the third reference value a13, the processor 500 may control the container 100 to be rotated at least one round in the predetermined direction R1, as shown in FIG. 21, by sending a control signal to the first driver 85. During the rotation of the container 100, the electrode part 110 is controlled not to operate.

The processor 500 resumes operation of the electrode part 110 at t22, as shown in FIG. 19, after the rotating operation of the container 100 is stopped. In this case, the processor 500 may determine an operating condition of the electrode part 110 again, and control operation of the electrode part 110 based on the operating condition. With the resumed operation of the electrode part 110, the RMC decreases as in a curve 122.

Furthermore, if determining that the RMC of the object 9 does not correspond to the third reference value a13, the processor 500 may control the electrode part 110 to keep operating.

If a certain time elapses after the operation of the electrode 110 is resumed or controlled to keep its operation because the RMC of the object 9 does not correspond to the third reference value a13, the processor 500 may determine again whether the RMC of the object 9 corresponds to the third reference. As described above, before the RMC of the object 9 is determined, the operation of the electrode part 110 may be stopped again at t23.

If determining that the RMC of the object 9 corresponds to the third reference value a13, the processor 500 controls the electrode part 110 not to operate as shown in FIGS. 18 and 22, and at the same time or at a different time, the air heater 310 may be controlled to operate at t23, as shown in FIG. 23.

When the air heater 310 operates, the processor 500 may control the flow path open/shut part 203 to connect the air inflow path 201 to the second air supply path 203. Accordingly, the hot air H2 is discharged into the receiving space 109 from the second air inlet 140 connected to the second air supply path 203. While the hot air H2 is being discharged into the receiving space 109, the container 100 may be rotated in the predetermined direction under the control of the processor 500.

The hot air H2 is moved to the first discharge port 260*a* with the moisture remaining in the moving object 9 inside the receiving space 109.

As the hot air H2 is supplied, the RMC of the object 9 decreases as in a curve 123 shown in FIG. 19.

After the drying by the hot air H2 is performed, the processor 500 may determine whether the RMC of the object 9 corresponds to a predetermined fourth reference. The fourth reference may include a predetermined fourth reference value a14 or an approximate value of the fourth reference value a14 to be compared with the RMC of the object 9. The fourth reference value a14 may be variously defined according to the designer's selection. The fourth reference value a14 may be defined to be the same as the first reference value a11. In other words, the fourth reference value a14 may be defined as e.g., an RMC of about 20%. The fourth reference value a14 may be defined based on the third reference value a13.

In an embodiment, when it is determined whether the RMC of the object 9 corresponds to the fourth reference, drying operation of the dryer 1 may be stopped. For example, heating operation of the air heater 310 and rotating operation of the container 100 may be stopped. In some embodiments, supplying the air C5 into the receiving space 109 may be stopped, or may be continued as shown in FIG. 24.

In another embodiment, even when it is determined whether the RMC of the object 9 corresponds to the fourth reference, drying operation of the dryer 1 may be continued.

If determining that the RMC of the object 9 does not correspond to the fourth reference, the processor 500 controls the operation of the electrode part 110 to be resumed and the operation of the air heater 310 to be stopped at t24, as shown in FIGS. 18, 19 and 23. As described above, when the electrode part 110 resumes its operation, the first air supply path 210 and the air inflow path 201 are connected and the container 100 stops its rotating operation.

After the lapse of a certain time, the processor 500 resumes operation of the air heater 310 and controls the electrode part 110 to stop operating. As described above, when the air heater 310 resumes its operation, the first air supply path 210 and the air inflow path 201 are connected for the hot air H2 to be supplied as shown in FIG. 22, and the container 100 is rotated.

After the lapse of a certain time after the operation of the air heater 310 is resumed, the processor 500 determines again whether the RMC of the object 9 corresponds to the fourth reference. If the RMC of the object 9 does not correspond to the fourth reference, the processor 500 may control the electrode part 110 and the air heater 310 to resume the operation of the electrode part 110 and stop the operation of the air heater 310 at t26 and t27.

As described above, the object 9 is dried by alternate operation of the electrode 110 and the air heater 310, and accordingly, the RMC of the object 9 decreases as in curves 124 to 128.

If the RMC of the object 9 is determined to correspond to the fourth reference, the processor 500 may control the air heater 310 to keep operating at t27 to t29, as shown in FIG. 25. When the air heater 310 operates, the second air supply path 230 and the air inflow path 201 are connected and the container 100 may be rotated. The object 9 is dried by the heated air H3 with the RMC as in a curve 129 of FIG. 23.

Subsequently, the processor 500 may determine whether the RMC of the object 9 corresponds to a predetermined fifth reference. The fifth reference may include e.g., a predetermined fifth reference value a15 or an approximate value of the fifth reference value a15 to be compared with the RMC of the object 9. The fifth reference value a15 may be determined based on an RMC as much as to terminate the drying process, and may be defined like the second reference value a12 as an RMC of about 2%.

If determining the RMC corresponds to the fifth reference, the processor 500 stops the drying process of the dryer 1 by stopping operation of the air heater 310, the first driver 85, and the second driver 87.

With the method as described above, the processor 500 may control the respective parts 85, 87, 89, 100, 203, 310 and accordingly, dry the object 9 more efficiently and effectively.

Various embodiments of a method for controlling a dryer will now be described with reference to FIGS. 26 to 28.

Figure 26:
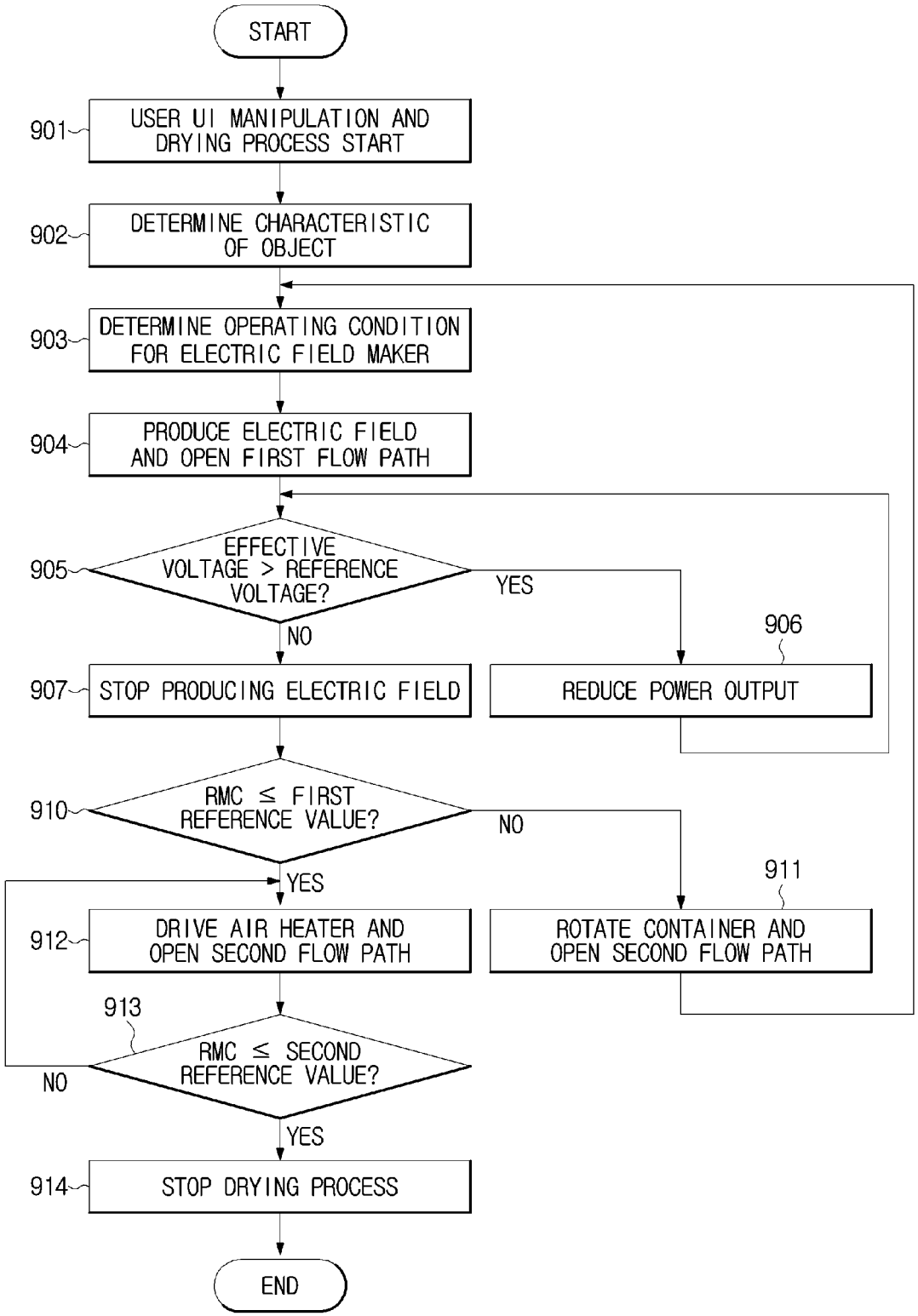
FIG. 26 is a flowchart illustrating a method for controlling a dryer, according to a first embodiment of the present disclosure.

FIG. 26 is a flowchart illustrating a method for controlling a dryer, according to a first embodiment of the present disclosure.

Referring to FIG. 26, after the user opens the door, throws an object to be dried into the receiving space of the container, shuts the door, and manipulates the user interface, the dryer begins a drying process, in operation 901.

The dryer determines a characteristic of the object, in operation 902. The characteristic of the object may be e.g., an RMC of the object. The dryer may estimate the characteristic value of the object using the matcher equipped in the dryer and may determine the RMC of the object based on the estimated characteristic value.

Once the characteristic of the object is determined, an operating condition of the electric field maker equipped on the inside of the container is determined. The operating condition may include e.g., an output of an RF signal or an effective voltage of the RF signal applied to the electric field maker, in operation 903.

In this case, the electric field maker functions as an anode and the container as a cathode. The electric field maker may be implemented using a certain conductive plate, such as a metal plate or a ceramic plate.

According to the determined operating condition, the power supplier outputs an RF signal to be applied to the electric field maker. In response to the application of the RF signal to the electric field maker, an electric field is produced between the electric field maker and the container, in operation 904.

At the same time as the electric field is produced or sequentially, the first air supply path is opened. The opening of the first air supply path may be performed using the flow path open/shut part arranged in the first air supply path. The first air inlet(s) is formed on the inside of the container to be close to the electric field maker within a certain range. With rotation of the container, the first air supply path may or may not be connected to the first air inlet. When the first air inlet arrives near the first air supply path as the container rotates, the air delivered to the first air supply path may be supplied into the receiving space of the container through the first air inlet.

As the electric field is produced, the moisture of the object in the receiving space is evaporated by induction heating, and the evaporated moisture is removed from the object along with the air supplied by opening the first air supply path. The moisture removed from the object is carried in the airflow to the first or second discharge port and released out of the receiving space.

In an embodiment, while the electric field maker is operating, it is determined whether the effective voltage of the matcher exceeds a reference voltage, in operation 905. The reference voltage may be determined in advance by at least one of the designer and the user.

If the effective voltage exceeds the reference voltage in operation 905, the power supplier is controlled to reduce its output, in operation 906.

If the effective voltage does not exceed the reference voltage in operation 905, the output of the power supplier is not adjusted and the existing operation of operation 904 is continued.

After the lapse of a certain time, generation of the electric field is stopped, in operation 907. The certain time may be determined by the designer or the user, or may be arbitrarily set by the dryer 1.

If the generation of electric field is stopped in operation 907, the dryer determines whether the RMC of the object corresponds to the first reference, in operation 910. Specifically, the dryer compares the RMC of the object with the first reference value to determine whether the RMC of the object corresponds to the first reference. The RMC of the object may be determined in the same method as in the operation 902 of determining the characteristic of the object. The first reference value may be defined by the designer or the user. For example, the first reference value may be an RMC of about 20%, without being limited thereto.

If the RMC of the object is greater than the first reference value in operation 910, the second air supply path is opened and the container starts rotating in a predetermined direction, in operation 911. The second air supply path is provided to be connected to the second air inlet formed on the rear side of the container. The second air inlet is formed on the rear side of the container to pass the air delivered to the second air supply path even when the container is rotated. In an embodiment, the second air inlet may be formed on the rear frame mounted on the rear side of the container. The container may be rotated at least one round.

Furthermore, the air heater may be controlled not to operate. Accordingly, the air moving in the second air supply path is delivered to the receiving space of the container through the second air inlet without being heated.

After this, an operating condition of the electric field maker is determined again in operation 903, and the electric field maker produces an electric field in the receiving space again according to the operating condition, and air is supplied into the receiving space through the first air supply path and the first air inlet, in operations 904 to 906. The generation of electric field may be stopped after the lapse of a certain time, in operation 907.

If the RMC of the object is smaller than the first reference value in operation 910, the second air supply path is opened and the air heater connected to the second air supply path starts to be driven in operation 912. The air heater heats the air moving in the second air supply path so that the heated air, i.e., hot air may be supplied into the receiving space through the second air supply port. While the hot air is being supplied, the container may keep rotating in at least one direction.

As the hot air is supplied, the overall temperature in the receiving space rises, and accordingly, the moisture of the object moving in the receiving space is evaporated. Furthermore, as the hot air moves, the moisture of the object moving in the receiving space is separated from the object.

After the drying by hot air is performed, the dryer determines whether the RMC of the object corresponds to the second reference, in operation 913. In an embodiment, whether the RMC of the object corresponds to the second reference may be determined by determining whether the RMC of the object is smaller than the second reference value. In this case, the hot air supply and the rotation of the container may be stopped if necessary. The second reference value may be defined by the designer or the user. For example, the second reference value may be an RMC of about 2%. However, it is not limited thereto.

If the RMC of the object is greater than the second reference value in operation 913, the drying operation by hot air is continued.

If the RMC of the object is smaller than the second reference value in operation 913, the dryer determines that the object has been sufficiently dried and finishes the drying process in operation 914. The drying process may be finished by stopping operations of the air heater, various blower fans, and the container.

Figure 27:
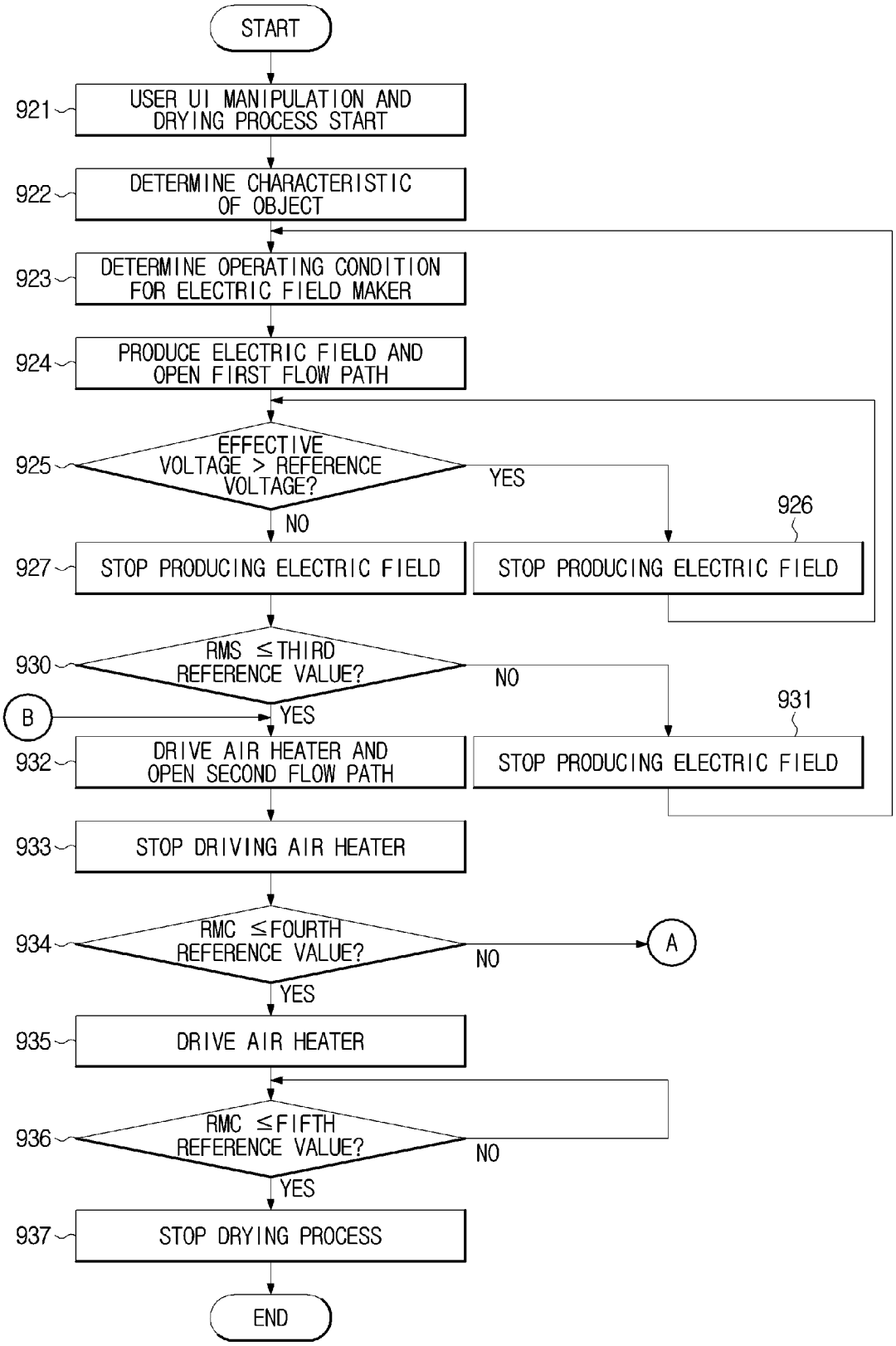
FIG. 27 is a first flowchart illustrating a method for controlling a dryer, according to a second embodiment of the present disclosure.
Figure 28:
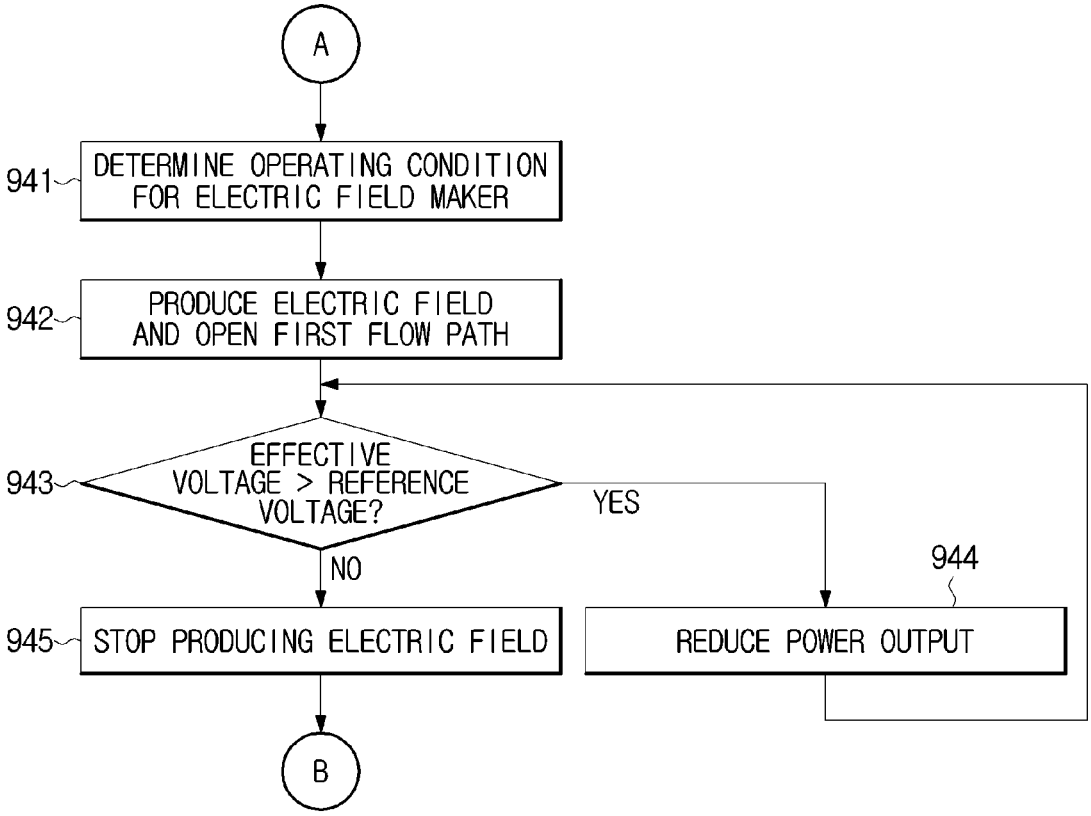
FIG. 28 is a second flowchart illustrating a method for controlling a dryer, according to a second embodiment of the present disclosure.

FIG. 27 is a first flowchart illustrating a method for controlling a dryer, according to a second embodiment of the present disclosure, and FIG. 28 is a second flowchart illustrating a method for controlling a dryer, according to a second embodiment of the present disclosure.

Referring to FIG. 27, as the user manipulates the user interface, the dryer starts a drying process, in operation 921.

Once the drying process begins, the dryer determines a characteristic of the object as described above, in operation 922. The characteristic of the object may be e.g., an RMC of the object.

Once the characteristic of the object is determined, the dryer determines an operating condition of the electric field maker, in operation 923.

When an RF signal is applied to the electric field maker according to the operating condition of the electric field maker, an electric field is produced in the receiving space, the first air supply path is opened, and the air delivered to the first air supply path is supplied to the receiving space of the container through the first air inlet, in operation 924.

In an embodiment, as described above, while the electric field maker is operating, it is determined whether the effective voltage of the matcher 504 exceeds a reference voltage, in operation 925.

If the effective voltage exceeds the reference voltage in operation 925, the power supplier is controlled to reduce its output in operation 926, and if the effective voltage does not exceed the reference voltage in operation 925, the existing operation 924 may be continued.

If the generation of electric field is stopped in operation 927, the dryer determines whether the RMC of the object corresponds to the third reference. As described above, to determine whether the RMC of the object corresponds to the third reference, the dryer compares the RMC of the object with the third reference value, in operation 930. The RMC of the object may be determined in the same method as in the operation 922 of determining the characteristic of the object. The third reference value may be defined by the designer or the user. For example, the third reference value may be defined as an RMC of about 40%. However, it is not limited thereto, but may be variously defined.

If the RMC of the object is greater than the third reference value in operation 930, the second air supply path is opened and the container starts rotating in a predetermined direction, in operation 931. In this case, the air heater may not operate and accordingly, the air that has passed the second air supply path may not be heated. Thus, relatively low temperature air flows into the receiving space of the container through the second air inlet.

After the lapse of a certain time after the start of rotation of the container, an operating condition of the electric field maker may be determined again in operation 923, and a drying process on the object based on an electric field may be performed again according to the operating condition in operations 924 to 927.

If the RMC of the object is smaller than the third reference value in operation 930, the second air supply path is opened and the air heater connected to the second air supply path starts to be driven in operation 932. Accordingly, the heated air is supplied into the receiving space through the second air supply port. While the hot air is being supplied, the container may be rotated in at least one direction.

After the lapse of a certain time set by the designer, the user, or the dryer, the air heater may stop the operation, in operation 933. In this case, the rotating operation of the container may also be stopped at the same time or at a different time.

Sequentially, the dryer determines whether the RMC of the object corresponds to the fourth reference, e.g., whether the RMC of the object is smaller than the fourth reference value, in operation 934. The fourth reference value may be defined by the designer or the user. The fourth reference value may be defined to be the same value as the first reference value. The fourth reference value may be defined as an RMC of about 20%, without being limited thereto.

If the RMC of the object is smaller than the fourth reference value in operation 934, the air heater of the dryer may resume the air heating operation and if required, the container may also resume its rotating operation in operation 935. Accordingly, hot air starts to be supplied into the receiving space again.

After the lapse of a certain time, the dryer determines whether the RMC of the object corresponds to the fifth reference, in operation 936. For example, the dryer may determine whether the RMC of the object corresponds to the fifth reference by determining whether the RMC of the object is smaller than the fifth reference value, in operation 936. The fifth reference value may be defined by the designer or the user, and may be defined as an RMC of about 2%. However, it is not limited thereto, but may be variously defined.

If the RMC of the object is greater than the fifth reference value in operation 936, the drying operation by the hot air is continued until the RMC of the object becomes smaller than the fifth reference value.

If the RMC of the object is smaller than the fifth reference value in operation 936, the air heating operation of the air heater is terminated and the operation of supplying hot air by the air heater is stopped. Accordingly, the drying process of the dryer is stopped, in operation 937.

If the RMC of the object is greater than the fourth reference value in operation 934, as shown in FIG. 28, a characteristic of the object and an operating condition of the electric field maker may be determined again in operation 941.

The first air supply path is opened, and the electric field maker produces an electric field in the receiving space according to the operating condition, in operation 942. Accordingly, drying operation on the object by an electric field is additionally performed again.

As described above, while the electric field maker is operating, whether an effective voltage of the matcher 504 exceeds a reference voltage may be further determined in operation 943, and according to whether the effective voltage exceeds the reference voltage, the output of the power supplier may or may not be adjusted in operations 943, 944. Specifically, if the effective voltage exceeds the reference voltage, the power supplier is controlled to reduce its output.

After the lapse of a predetermined period of time selected by e.g., the designer, application of the RF signal to the electric field maker is terminated, and in response generation of an electric field for the inside of the receiving space is terminated, in operation 927.

Once the generation of electric field is stopped, as shown in FIG. 27, the air heater starts being driven and the second air supply path is opened, in 932.

After that, the driving of the air heater is stopped in operation 933 and it is determined whether the RMC reaches the fourth reference value in operation 934. Depending on the determination, drying operation by electric field may be performed again in operations 941 to 945 or drying operation by hot air may be performed in operation 935. For example, as described above, if the RMC is greater than the fourth reference value, drying operation by electric field may be performed in operations 941 to 945, and if the RMC is smaller than the fourth reference value, drying operation by hot air may be performed in operation 935.

As described above, when the drying operation by hot air is performed in operation 935, comparison between the RMC and the fifth reference value may be performed in operation 936, and depending on the comparison with the fifth reference value, the drying process of the dryer may be stopped in operation 937

According to embodiments of the present disclosure, a dryer and method for controlling the same may perform a more appropriate, efficient, and effective drying process on an object by using high frequency electric field and heated air.

According to embodiments of the present disclosure, a dryer and method for controlling the same may solve a problem of a decrease in drying efficiency caused by reduced amount of remaining water molecules of an object in the course of a drying process in a case of drying the object using a high frequency.

Furthermore, according to embodiments of the present disclosure, a dryer and method for controlling the same may stir an object more often than in a case of drying the object only with a high frequency electric field, thereby minimizing generation of wrinkle caused by reduced stirring.

The method for controlling the dryer in accordance with the aforementioned embodiments may be implemented in the form of a program that may be carried out by various computer devices. The program herein may include program instructions, data files, data structures, etc., alone or in combination. The program may be designed or made using machine language codes or advanced language codes. The program may be specially designed to implement the method for controlling a dryer, and may be implemented using various usable functions or definitions known to ordinary skilled people in computer software applications.

The program to implement the method for controlling a dryer may be recorded on a computer-readable recording medium. The computer-readable recording medium may include various types of hardware devices that may store particular programs that are executed by calls from computers, magnetic disk storage media like hard disks or floppy disks, magnetic tapes, optical media like compact discs (CDs) or digital versatile disks (DVDs), magneto-optical media like floptical disks, or semiconductor storage devices like read only memories (ROMs), random access memories (RAMs), or flash memories.

Although various embodiments of a dryer and method for controlling the same are described above, the dryer and method for controlling the same is not exclusively limited to the embodiments. Various other embodiments that may be implemented by ordinary skilled people in the art modifying and changing the aforementioned embodiments may also fall within the scope of the present disclosure. For example, the aforementioned method may be performed in different order, and/or the aforementioned systems, structures, devices, circuits, etc., may be combined in different combinations from what is described above, and/or replaced or substituted by other components or equivalents thereof, to obtain appropriate results.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A dryer comprising:

a main body;

a drum rotationally placed inside the main body;

a driving part configured to provide rotational force to the drum;

an electrode part configured to produce an electric field inside the drum;

a power supplier configured to supply power to the electrode part;

an air heater configured to heat air;

a blower configured to supply heated air into the drum; and a controller configured to:

control the power supplier to block power supplied to the electrode part depending on a dried state of an object contained in the drum, control the driving part to rotate the drum, and control the air heater and the blower to supply heated air into the drum.

2. The dryer of claim 1, wherein the controller is further configured to control the driving part to rotate the drum at the same time as or after the power supplied to the electrode part is blocked.

3. The dryer of claim 2, wherein the controller is further configured to control the air heater and the blower to supply heated air into the drum at the same time as or after the drum starts rotating.

4. The dryer of claim 1, wherein the controller is further configured to drop an output of the power supplier when a voltage applied to the electrode part exceeds a reference voltage.

5. The dryer of claim 1, further comprising:

a first air inlet formed around the electrode part; and a second air inlet formed in a direction of a rear side of a container.

6. The dryer of claim 5, further comprising:

an air inflow path through which air flows in;

a first air supply path connected to the first air inlet;

a second air supply path connected to the second air inlet; and a flow path open/shut part configured to connect one of the first and second air supply paths to the air inflow path.

7. The dryer of claim 6, wherein the flow path open/shut part is configured to:

connect the first air supply path to the air inflow path when the power supplier is operating, and connect the second air supply path to the air inflow path when the power supplier is not operating.

8. The dryer of claim 6, wherein the air heater is installed in the second air supply path.

9. A dryer comprising:

a cylindrical drum rotationally placed inside a main body and equipped with an inlet on a front of the cylindrical drum;

an electrode part configured to produce an electric field in a perpendicular direction to a rotation center of the cylindrical drum;

a first air inlet formed on a cylindrical wall of the cylindrical drum; and a second air inlet formed on a back of the cylindrical drum, wherein when the cylindrical drum is not rotating, air is supplied into the cylindrical drum through the first air inlet, and when the cylindrical drum is rotating, air is supplied into the cylindrical drum through the second air inlet.

10. The dryer of claim 9, further comprising:

an air heater configured to heat the air supplied into the cylindrical drum through the second air inlet.

11. The dryer of claim 10, wherein the air supplied into the cylindrical drum is discharged out of the cylindrical drum through a discharge port.

12. The dryer of claim 9, further comprising:

a first air inlet formed around the electrode part; and a second air inlet formed in a direction of a rear side of a container.

13. The dryer of claim 9, further comprising:

an air inflow path through which air flows in;

a first air supply path connected to the first air inlet;

a second air supply path connected to the second air inlet; and a flow path open/shut part configured to connect one of the first and second air supply paths to the air inflow path.

14. A method for controlling a dryer including a rotary drum, the method comprising:

producing an electric field by an electrode part installed inside the rotary drum;

determining whether to operate a power supplier to supply power to the electrode part depending on a dried state of an object contained in the rotary drum;

blocking power supplied to the electrode part according to the determination of whether to operate the power supplier; and starting rotation of the rotary drum and supplying heater air into the rotary drum.

15. The method of claim 14, wherein the starting of rotation of the rotary drum and supplying heater air into the rotary drum comprises:

rotating the rotary drum at the same time as the power supplied to the electrode part is blocked; or rotating the rotary drum after the power supplied to the electrode part is blocked.

16. The method of claim 15, wherein the starting of rotation of the rotary drum and supplying heater air into the rotary drum comprises:

supplying heated air into the rotary drum at the same time as the starting of rotation of the rotary drum; or supplying heated air into the rotary drum after the starting of rotation of the rotary drum.

17. The method of claim 16, further comprising:

dropping an output of the power supplier when a voltage applied to the electrode part exceeds a reference voltage.

18. The method of claim 14, further comprising:

allowing air to flow into the rotary drum through a first air inlet formed around the electrode part when the power supplier operates and produces an electric field in receiving space of a container of the dryer.

19. The method of claim 14, wherein the starting of rotation of the rotary drum and supplying heater air into the rotary drum comprises:

supplying the heated air into the rotary drum through a second air inlet formed in a direction of a back of the rotary drum.

20. The method of claim 14, further comprising:

discharging the heated air supplied into the rotary drum to the outside of the rotary drum through a discharge port.

* * * * *